US011366404B2

(12) United States Patent
Nakamoto et al.

(10) Patent No.: US 11,366,404 B2
(45) Date of Patent: Jun. 21, 2022

(54) IMAGE FORMING APPARATUS AND ADJUSTING METHOD

(71) Applicant: Ricoh Company, Ltd., Tokyo (JP)

(72) Inventors: Atsushi Nakamoto, Kanagawa (JP); Seiichi Kogure, Kanagawa (JP); Daisuke Hamada, Kanagawa (JP); Takuya Akiyama, Kanagawa (JP); Yuuki Aoki, Tokyo (JP); Yutaka Goto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/226,156

(22) Filed: Apr. 9, 2021

(65) Prior Publication Data

US 2021/0333725 A1 Oct. 28, 2021

(30) Foreign Application Priority Data

Apr. 23, 2020 (JP) ..... JP2020-076674
Mar. 2, 2021 (JP) ..... JP2021-032573

(51) Int. Cl.
*G03G 15/041* (2006.01)
*G03G 15/16* (2006.01)

(52) U.S. Cl.
CPC ..... *G03G 15/0415* (2013.01); *G03G 15/161* (2013.01)

(58) Field of Classification Search
CPC ..... G03G 15/0415; G03G 15/161
See application file for complete search history.

(56) References Cited

U.S. PATENT DOCUMENTS

2011/0211855 A1 9/2011 Kogure et al.
2013/0216260 A1 8/2013 Kogure et al.
2016/0041508 A1 2/2016 Kogure et al.
(Continued)

FOREIGN PATENT DOCUMENTS

CN 102681381 A * 9/2012 ..... G03G 15/167
JP 2006-264900 10/2006
(Continued)

OTHER PUBLICATIONS

English machine translation of Furuichi (CN 102681381 A) (Year: 2012).*

*Primary Examiner* — Walter L Lindsay, Jr.
*Assistant Examiner* — Geoffrey T Evans
(74) *Attorney, Agent, or Firm* — Xsensus LLP

(57) ABSTRACT

An image forming apparatus includes an image bearer, a transfer rotator, an adjuster, and circuitry. The image bearer bears a toner image. The transfer rotator contacts the image bearer to form a transfer nip between the transfer rotator and the image bearer. The transfer rotator transfers the toner image from the image bearer onto a sheet conveyed to the transfer nip. The adjuster adjusts at least one of a relative difference in linear velocity of the transfer rotator to the image bearer at the transfer nip and a relative contact pressure of the transfer rotator to the image bearer at the transfer nip. Based on a difference in image magnification, in a direction of conveyance of the sheet, of toner images transferred onto surfaces of one or more sheets conveyed to the transfer nip, the circuitry causes the adjuster to reduce the difference in image magnification.

16 Claims, 6 Drawing Sheets

(56) References Cited

U.S. PATENT DOCUMENTS

| | | | | |
|---|---|---|---|---|
| 2016/0170363 | A1 | 6/2016 | Kogure et al. | |
| 2016/0170364 | A1 | 6/2016 | Kogure et al. | |
| 2018/0157196 | A1 | 6/2018 | Kogure et al. | |
| 2019/0171137 | A1 | 6/2019 | Kobayashi | |
| 2019/0171154 | A1 | 6/2019 | Kobayashi et al. | |
| 2020/0301319 | A1* | 9/2020 | Nakura ..... | G03G 15/1685 |
| 2021/0063919 | A1 | 3/2021 | Nakamoto et al. | |

FOREIGN PATENT DOCUMENTS

| | | |
|---|---|---|
| JP | 2011-033767 | 2/2011 |
| JP | 2014-232141 | 12/2014 |
| JP | 2018-170734 | 11/2018 |
| JP | 2019-098734 | 6/2019 |
| JP | 2019-101326 | 6/2019 |

* cited by examiner

IMAGE FORMING APPARATUS AND ADJUSTING METHOD

CROSS-REFERENCE TO RELATED APPLICATIONS

This patent application is based on and claims priority pursuant to 35 U.S.C. § 119(a) to Japanese Patent Application Nos. 2020-076674, filed on Apr. 23, 2020, and 2021-032573, filed on Mar. 2, 2021, in the Japan Patent Office, the entire disclosure of each of which is hereby incorporated by reference herein.

BACKGROUND

Technical Field

Embodiments of the present disclosure relate to an image forming apparatus such as a copier, a printer, a facsimile machine, or a multifunction peripheral having at least two of copying, printing, and facsimile functions, and an adjusting method for the image forming apparatus.

Related Art

There is typically known an image forming apparatus such as a copier or a printer in which a transfer rotator such as a transfer belt or a transfer roller contacts an image bearer such as an intermediate transfer belt or a drum-shaped photoconductor to form a transfer nip between the transfer rotator and the image bearer.

Specifically, in such an image forming apparatus, for example, toner images formed on the respective drum-shaped photoconductors are primarily transferred onto the surface of the intermediate transfer belt as an image bearer such that the toner images are superimposed one atop another to be a composite toner image. Thereafter, the composite toner image borne by the intermediate transfer belt is secondarily transferred onto a sheet conveyed to the position of a secondary transfer nip as a transfer nip. The sheet bearing the secondarily transferred toner image is conveyed toward a fixing device, which fixes the toner image onto the sheet. The sheet bearing the fixed toner image is finally discharged from a body of the image forming apparatus.

SUMMARY

In one embodiment of the present disclosure, a novel image forming apparatus includes an image bearer, a transfer rotator, an adjuster, and circuitry. The image bearer is configured to bear a toner image. The transfer rotator is configured to contact the image bearer to form a transfer nip between the transfer rotator and the image bearer. The transfer rotator is configured to transfer the toner image from the image bearer onto a sheet conveyed to the transfer nip. The adjuster is configured to adjust at least one of a relative difference in linear velocity of the transfer rotator to the image bearer at the transfer nip and a relative contact pressure of the transfer rotator to the image bearer at the transfer nip. The circuitry is configured to, based on a difference in image magnification, in a direction of conveyance of the sheet, of toner images transferred onto surfaces of one or more sheets conveyed to the transfer nip, cause the adjuster to reduce the difference in image magnification.

Also described is a novel adjusting method for the image forming apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
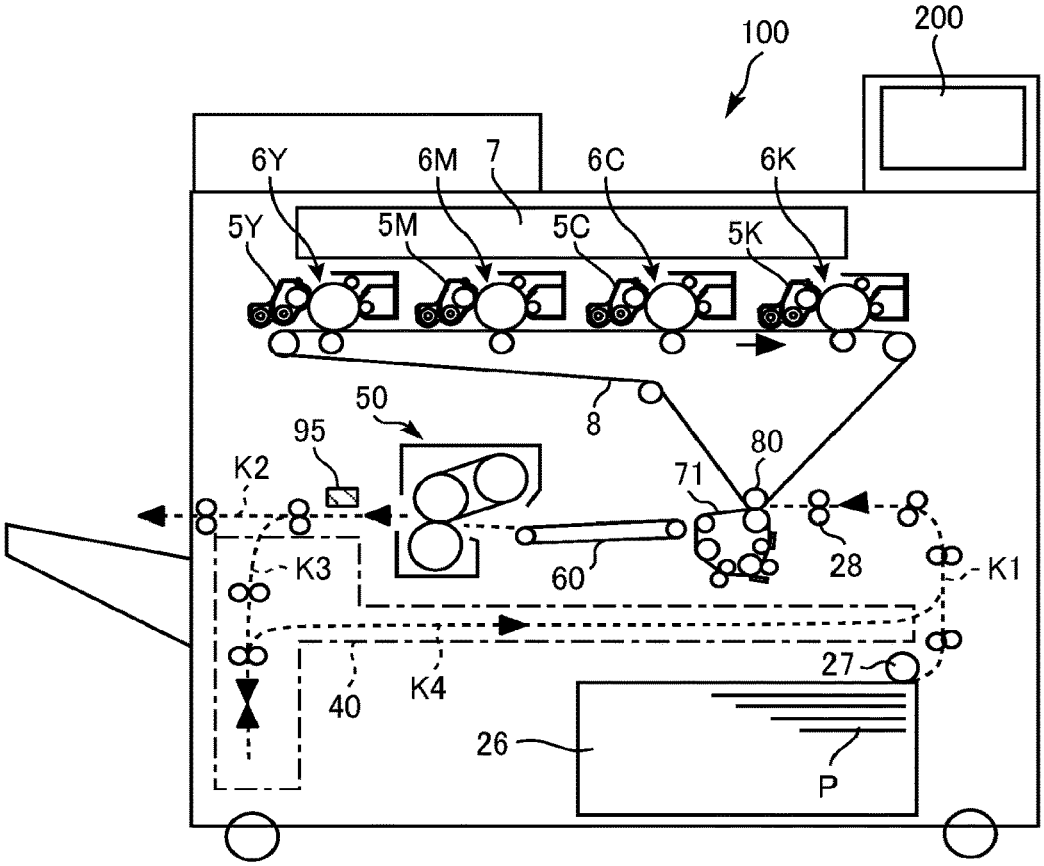
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result. As used herein, the singular forms "a," "an," and "the" are intended to include the plural forms as well, unless the context clearly indicates otherwise.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

It is to be noted that, in the following description, suffixes Y, M, C, and K denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Figure 2:
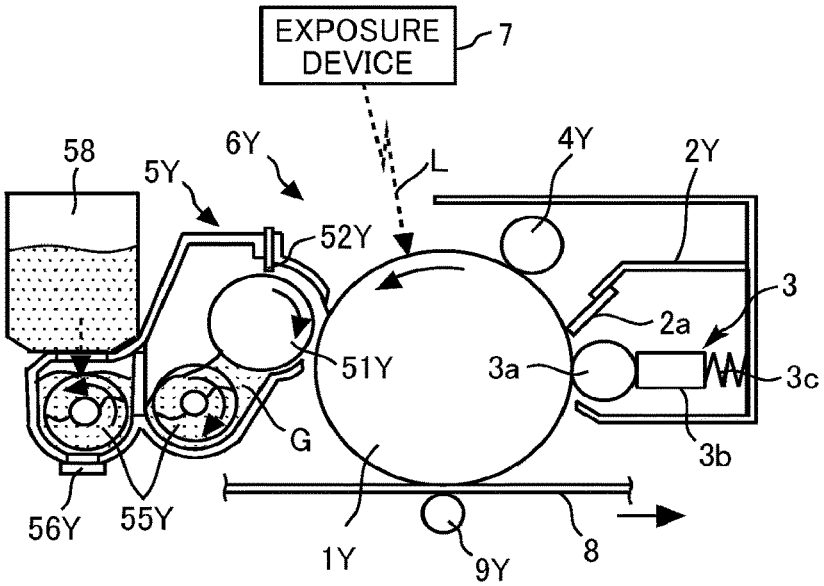
FIG. 2 is a partially enlarged view of an image forming device.

Initially with reference to FIGS. 1 and 2, a description is given of overall configuration and operation of an image forming apparatus 100 according to an embodiment of the present disclosure.

FIG. 1 is a schematic view of the image forming apparatus 100, which is a printer in the present embodiment. Alternatively, the image forming apparatus 100 may be a copier, a facsimile machine, a scanner, or a multifunction peripheral (MFP) having at least two of copying, printing, scanning, and facsimile functions. FIG. 2 is a partially enlarged view of an image forming device incorporated in the image forming apparatus 100.

As illustrated in FIG. 1, the image forming apparatus 100 includes an intermediate transfer belt 8 serving as an image bearer and an intermediate transferor in a center portion of a body of the image forming apparatus 100. The image forming apparatus 100 further includes image forming devices 6Y, 6M, 6C, and 6K disposed opposite the intermediate transfer belt 8 to form toner images of yellow, magenta, cyan, and black, respectively.

Referring to FIG. 2, the image forming device 6Y that forms a yellow toner image includes a drum-shaped photoconductor 1Y and various pieces of equipment disposed around the photoconductor 1Y, such as a charger 4Y, a developing device 5Y, a cleaner 2Y, a lubricant supplier 3, and a charge neutralizer. A series of image forming processes including charging, exposure, developing, primary transfer, cleaning, and charge neutralizing processes is performed on the photoconductor 1Y. Accordingly, the yellow toner image is formed on the surface of the photoconductor 1Y.

The image forming devices 6Y, 6M, 6C, and 6K have substantially the same configurations, differing from each other only in the color of toner employed. The image forming devices 6Y, 6M, 6C, and 6K perform the same series of image forming processes to form toner images of the respective colors. A description is now given of the series of image forming processes performed by the image forming device 6Y to form the yellow toner image, as a representative of the image forming devices 6Y, 6M, 6C, and 6K With continued reference to FIG. 2, the photoconductor 1Y is rotated by a drive motor counterclockwise in FIG. 2. The surface of the photoconductor 1Y is uniformly charged at a position opposite the charger 4Y in the charging process.

The photoconductor 1Y is rotated further and reaches a position opposite an exposure device 7, where the surface of the photoconductor 1Y is irradiated with laser light L emitted from the exposure device 7 and scanned in a width direction, which is a main scanning direction perpendicular to the surface of the paper on which FIGS. 1 and 2 are drawn. Thus, the exposure device 7 forms or writes an electrostatic latent image corresponding to yellow on the surface of the photoconductor 1Y in the exposure process.

Thereafter, the photoconductor 1Y is rotated further and reaches a position opposite the developing device 5Y, where the electrostatic latent image is developed into a visible toner image of yellow in the developing process.

The photoconductor 1Y is rotated further and reaches a position opposite a primary transfer roller 9Y via the intermediate transfer belt 8, where the toner image is primarily transferred from the surface of the photoconductor 1Y onto an outer circumferential surface of the intermediate transfer belt 8 in the primary transfer process. At this time, a small amount of toner may remain untransferred on the surface of the photoconductor 1Y as residual toner.

Thereafter, the photoconductor 1Y is rotated further and reaches a position opposite the cleaner 2Y, where the residual, untransferred toner on the surface of the photoconductor 1Y is collected by a cleaning blade 2*a* into the cleaner 2Y in the cleaning process.

Inside the cleaner 2Y is the lubricant supplier 3 serving as a lubricant supplier for a photoconductor. The lubricant supplier 3 includes a lubricant supply roller 3*a*, a solid lubricant 3*b*, and a compression spring 3*c*. While rotating clockwise in FIG. 2, the lubricant supply roller 3*a* gradually scrapes the solid lubricant 3*b* off to supply the lubricant to the surface of the photoconductor 1Y.

The photoconductor 1Y is rotated further and finally reaches a position opposite the charge neutralizer, where the residual potential is removed from the surface of the photoconductor 1Y in the charge neutralizing process.

Thus, the series of image forming processes performed on the surface of the photoconductor 1Y is completed.

Note that the other image forming devices 6M, 6C, and 6K perform the series of image forming processes described above in substantially the same manner as the image forming device 6Y. That is, the exposure device 7 disposed above the image forming devices 6Y, 6M, 6C, and 6K irradiates the photoconductors 1M, 1C, and 1K of the image forming devices 6M, 6C, and 6K, respectively, with the laser light L according to image data. Specifically, in the exposure device 7, a light source emits the laser light L, which is deflected by a polygon mirror rotated. The laser light L then reaches the photoconductor 1 via multiple optical elements. Thus, the exposure device 7 scans the surface of each of the photoconductors 1M, 1C, and 1K. Note that a plurality of light emitting diodes (LEDs) may be arranged side by side in the width direction as the exposure device 7.

After the exposure device 7 irradiates the photoconductors 1M, 1C, and 1K, developing devices 5M, 5C, and 5K develop electrostatic latent images into visible magenta, cyan, and black toner images, respectively. The magenta, cyan, and black toner images respectively formed on the photoconductors 1M, 1C, and 1K are primarily transferred onto the intermediate transfer belt 8 such that the magenta, cyan, and black toner images are superimposed one atop another as a composite color toner image on the intermediate transfer belt 8.

Figure 3:
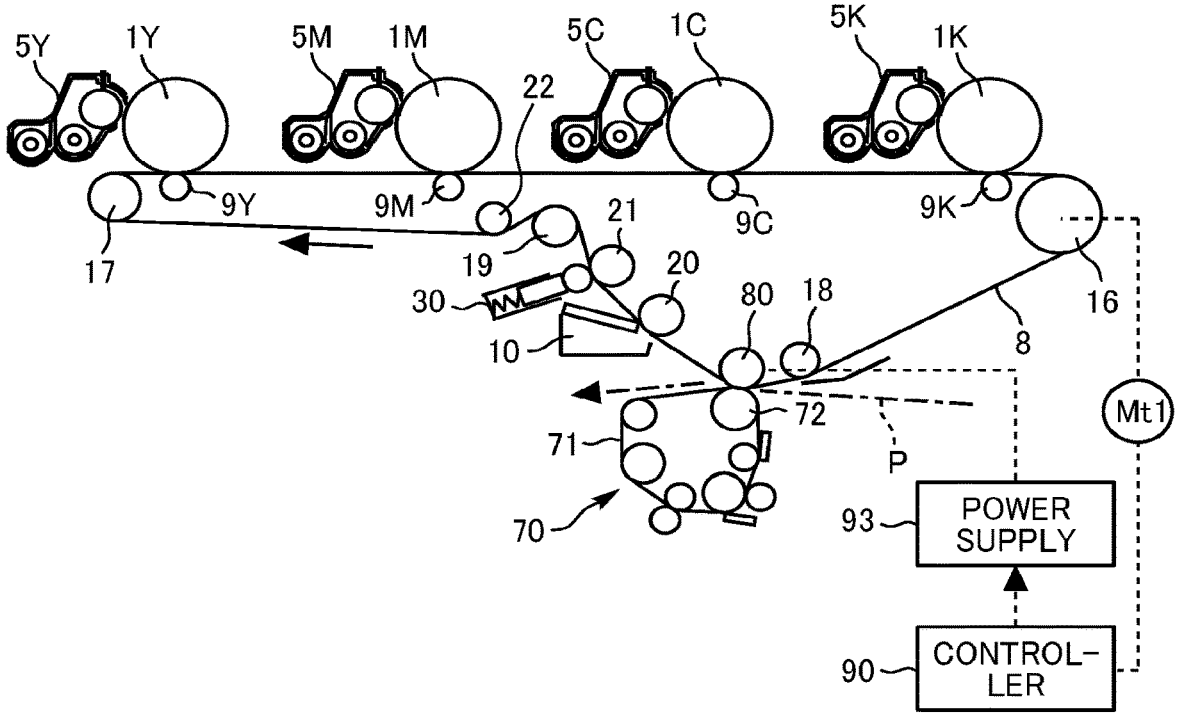
FIG. 3 is a schematic view of an intermediate transfer belt and components around the intermediate transfer belt.

Referring now to FIG. 3, the intermediate transfer belt 8 serving as an image bearer is entrained around and supported by multiple rollers 16 to 22 and 80. Thus, the intermediate transfer belt 8 is formed into an endless loop. As a drive motor Mt1 drives and rotates a driving roller 16 of the multiple rollers 16 to 22 and 80, the intermediate transfer belt 8 is rotated in a direction indicated by arrow in FIG. 3.

Each of four primary transfer rollers 9Y, 9M, 9C, and 9K sandwich the intermediate transfer belt 8 with the corresponding one of the photoconductors 1Y, 1M, 1C, and 1K to form an area of contact, herein called a primary transfer nip, between the intermediate transfer belt 8 and the corresponding one of the photoconductors 1Y, 1M, 1C, and 1K. Each of the primary transfer rollers 9Y, 9M, 9C, and 9K is supplied with a transfer voltage (i.e., a primary transfer bias) having a polarity opposite a polarity of toner.

The intermediate transfer belt 8 travels in a direction indicated by arrow in FIG. 3 while successively passing through the primary transfer nips formed between the primary transfer rollers 9Y, 9M, 9C, and 9K, on the one hand, and the photoconductors 1Y, 1M, 1C, and 1K, on the other hand, respectively. Thus, the toner images formed on the respective photoconductors 1Y, 1M, 1C, and 1K are primarily transferred onto the intermediate transfer belt 8 while being superimposed one atop another to form a composite color toner image on the intermediate transfer belt 8 in the primary transfer process.

Thereafter, the intermediate transfer belt 8 bearing the composite color toner image reaches a position opposite a secondary transfer belt 71 serving as a transfer rotator. At this position, a secondary transfer opposed roller 80 sandwiches the intermediate transfer belt 8 and the secondary transfer belt 71 with a secondary transfer roller 72 to form an area of contact, herein called a secondary transfer nip (as a transfer nip), between the intermediate transfer belt 8 and the secondary transfer belt 71. At the secondary transfer nip, the composite color toner image (or four-color toner image) is secondarily transferred from the intermediate transfer belt 8 onto a sheet P serving as a recording medium conveyed to the secondary transfer nip, in a secondary transfer process. At this time, a small amount of toner may remain untransferred on the intermediate transfer belt 8 as residual toner.

Thereafter, the intermediate transfer belt 8 reaches a position opposite an intermediate transfer cleaner 10. At this position, the intermediate transfer cleaner 10 removes extraneous matter such as the residual toner adhering to the surface of the intermediate transfer belt 8.

Thereafter, the intermediate transfer belt 8 reaches a position opposite a lubricant supplier 30 serving as an intermediate transfer lubricant supply device. At this position, the lubricant supplier 30 supplies a lubricant to the outer circumferential surface of the intermediate transfer belt 8.

Thus, a series of transfer processes performed on the outer circumferential surface of the intermediate transfer belt 8 is completed.

Referring back to FIG. 1, the sheet P is conveyed from a sheet feeder 26 disposed in a lower portion of the body of the image forming apparatus 100 to the secondary transfer nip via a sheet feeding roller 27 and a registration roller pair 28, for example.

Specifically, the sheet feeder 26 accommodates a plurality of sheets P, such as transfer sheets, resting one atop another. The sheet feeding roller 27 is rotated counterclockwise in FIG. 1 to pick up and feed an uppermost sheet P of the plurality of sheets P toward between rollers of the registration roller pair 28 via a first conveyance passage K1.

The sheet P thus conveyed to the registration roller pair 28 serving as a timing roller pair temporarily stops at an area of contact, herein called a roller nip, between the rollers of the registration roller pair 28 that stops rotating. Rotation of the registration roller pair 28 is timed to convey the sheet P toward the secondary transfer nip such that the sheet P meets the color toner image on the intermediate transfer belt 8 at the secondary transfer nip. Thus, the desired color toner image is transferred onto the sheet P.

The sheet P bearing the color toner image is then conveyed on the secondary transfer belt 71. After being separated from the secondary transfer belt 71, the sheet P is conveyed on a conveyor belt 60 to a fixing device 50. In the fixing device 50, the color toner image is fixed onto the sheet P under heat and pressure from a fixing belt and a pressure roller in a fixing process.

Thereafter, the sheet P bearing the fixed toner image is conveyed through a second conveyance passage K2 and ejected outside the image forming apparatus 100 by an output roller pair. In this manner, the sheets P bearing output images are ejected by the output roller pair one at a time onto an output tray outside the body of the image forming apparatus 100. Thus, the sheets P lie stacked on the output tray.

Thus, a series of image forming processes (i.e., image forming operation) of the image forming apparatus 100 is completed.

As illustrated in FIG. 1, a line sensor 95 used in an adjustment mode is disposed downstream from the fixing device 50 and upstream from a branch portion between the second conveyance passage K2 and a third conveyance passage K3 in a sheet conveying direction in which the sheet P is conveyed. A detailed description of the line sensor 95 is deferred.

As illustrated in FIG. 1, the image forming apparatus 100 of the present embodiment includes a sheet reversal device 40 that conveys a sheet P bearing a toner image transferred onto a front side of the sheet P toward the secondary transfer nip to transfer another toner image from the intermediate transfer belt 8 serving as an image bearer onto a back side of the sheet P at the secondary transfer nip as a transfer nip.

Specifically, when a "single-sided printing mode" is selected to form an image on a single side of the sheet P, the sheet P is ejected outside the body of the image forming apparatus 100 after the image is fixed onto the sheet P. By contrast, when a "double-sided printing mode" is selected to form an image on each side (i.e., each of the front and back sides) of the sheet P, the sheet P is directed to the third conveyance passage K3 in the sheet reversal device 40, instead of being ejected as in the "single-sided printing mode" described above, after the image is fixed onto the sheet P. The direction of conveyance of the sheet P directed to the third conveyance passage K3 is then reversed so that the sheet P is conveyed toward the secondary transfer nip, formed by a secondary transfer device 70 illustrated in FIG. 3, again via a fourth conveyance passage K4. Note that the direction of conveyance of the sheet P may be hereinafter referred to as the sheet conveying direction. At the secondary transfer nip, another toner image is formed on, or secondarily transferred onto, the back side of the sheet P in the series of image forming processes (i.e., image forming operation) as described above. The sheet P is then conveyed to the fixing device 50, which fixes the toner image onto the back side of the sheet P. The sheet P bearing the fixed toner image on each side of the sheet P is then ejected from the body of the image forming apparatus 100 via the second conveyance passage K2.

Referring now to FIG. 2, a detailed description is given of a configuration and operation of the developing device 5Y in the image forming device 6Y.

The developing device 5Y includes a developing roller 51Y, a doctor blade 52Y, two conveyor screws 55Y, and a density detection sensor 56Y. The developing roller 51Y is disposed opposite the photoconductor 1Y. The doctor blade 52Y is disposed opposite the developing roller 51Y. The two conveyor screws 55Y are disposed in a developer container. The density detection sensor 56Y detects the toner density in a developer G. The developing roller 51Y includes a magnet and a sleeve. The magnet is secured inside the developing roller 51Y. The sleeve rotates about the magnet. The developer container contains the developer G, which is a two-component developer including carrier (or carrier particles) and toner (or toner particles).

The developing device 5Y having the configuration described above operates as follows.

The sleeve of the developing roller 51Y rotates in a direction indicated by arrow in FIG. 2. The magnet generates a magnetic field, which moves the developer G borne on the developing roller 51Y along with rotation of the sleeve on the developing roller 51Y. The developer Gin the developing device 5Y is adjusted so that the percentage of toner (i.e., the toner density) in the developer G falls within a given range. Specifically, when the density detection sensor 56Y disposed in the developing device 5Y detects a low toner density, fresh toner is supplied from a toner container 58 into the developing device 5Y so that the toner density falls within the given range.

The toner supplied into the developer container from the toner container 58 is circulated in two isolated chambers of the developer container while being stirred and mixed with the developer G by the two conveyor screws 55Y located in the respective chambers, thus moving in a direction perpendicular to the surface of the paper on which FIG. 2 is drawn). The toner in the developer G is electrically charged by friction with the carrier and thus is attracted to the carrier. Both the toner and the carrier are borne on the developing roller 51Y due to a magnetic force generated on the developing roller 51Y.

The developer G borne on the developing roller MY is conveyed in the direction indicated by arrow in FIG. 2 and reaches a position opposite the doctor blade 52Y. At this position, the doctor blade 52Y adjusts the amount of the developer G on the developing roller 51 to an appropriate amount. Thereafter, the developer G on the developing roller 51Y is conveyed to a position opposite the photoconductor 1Y (i.e., a developing area). In the developing area, the toner is attracted to the latent image formed on the photoconductor 1Y by an electric field generated in the developing area. Thereafter, the developer G remaining on the developing roller 51Y is conveyed to an upper portion of the developer container along with rotation of the sleeve of the developing roller 51Y, where the developer G is separated from the developing roller 51Y.

Note that the toner container 58 is removably (or replaceably) mounted in the developing device 5Y. In other words, the toner container 58 is removably (or replaceably) mounted in the image forming apparatus 100. Specifically, when the fresh toner contained in the toner container 58 is consumed and the toner container 58 becomes empty, the toner container 58 is removed from the developing device 5Y (in other words, the toner container 58 is removed from the image forming apparatus 100) and replaced with a new toner container 58.

Referring now to FIG. 3, a detailed description is given of an intermediate transfer belt device according to the present embodiment.

As illustrated in FIG. 3, the intermediate transfer belt device includes, e.g., the intermediate transfer belt 8 serving as an image bearer, the four primary transfer rollers 9Y, 9M, 9C, and 9K, the driving roller 16, a driven roller 17, a pre-transfer roller 18, a tension roller 19, a cleaning opposed roller 20, a lubricant facing roller 21, a backup roller 22, the intermediate transfer cleaner 10, the lubricant supplier 30 serving as an intermediate transfer lubricant supply device, the secondary transfer opposed roller 80, and the secondary transfer device 70.

The intermediate transfer belt 8 contacts the four photoconductors 1Y, 1M, 1C, and 1K, which bear toner images of the respective colors, to form the respective primary transfer nips between the intermediate transfer belt 8 and the photoconductors 1Y, 1M, 1C, and 1K. The intermediate transfer belt 8 is entrained around and supported by mainly eight rollers, namely, the driving roller 16, the driven roller 17, the pre-transfer roller 18, the tension roller 19, the cleaning opposed roller 20, the lubricant facing roller 21, the backup roller 22, and the secondary transfer opposed roller 80.

In the present embodiment, the intermediate transfer belt 8 is a belt formed in a single layer or multiple layers of, e.g., polyvinylidene fluoride (PVDF), ethylene-tetrafluoroethylene copolymer (ETFE), polyimide (PI), or polycarbonate (PC) and having a conductive material such as carbon black dispersed. The intermediate transfer belt 8 is adjusted to have a volume resistivity in a range of $10^6$ Ωcm to $10^{13}$ Ωcm and an inner circumferential surface resistivity in a range of $10^7$ Ωcm to $10^{13}$ Ωcm. The intermediate transfer belt 8 has a thickness in a range of 20 μm to 200 μm. In the present embodiment, the intermediate transfer belt 8 has a thickness of about 60 μm and a volume resistivity of about $10^9$ Ωcm.

In the present embodiment, the intermediate transfer belt 8 includes an elastic layer made of, e.g., rubber as an intermediate layer. The intermediate transfer belt 8 provided with the elastic layer prevents a decrease in transferability at the secondary transfer nip when the sheet P having an uneven surface passes through the secondary transfer nip.

Optionally, the surface of the intermediate transfer belt 8 may be coated with a release layer. In this case, a fluorine resin such as ETFE, polytetrafluoroethylene (PTFE), PVDF, perfluoroalkoxy fluorine resin (PEA), tetrafluoroethylene-hexafluoropropylene copolymer (FEP), or vinyl fluoride (PVF) may be used as a material for the coating. Note that the material for the coating is not limited to the fluoro resin.

The primary transfer rollers 9Y, 9M, 9C, and 9K contact the photoconductors 1Y, 1M, 1C, and 1K, respectively, via the intermediate transfer belt 8. Specifically, the primary transfer roller 9Y for yellow contacts the photoconductor 1Y for yellow via the intermediate transfer belt 8. The primary transfer roller 9M for magenta contacts the photoconductor 1M for magenta via the intermediate transfer belt 8. The primary transfer roller 9C for cyan contacts the photoconductor 1C for cyan via the intermediate transfer belt 8. The primary transfer roller 9K for black contacts the photoconductor 1K for black via the intermediate transfer belt 8. Each of the primary transfer rollers 9Y, 9M, 9C, and 9K is an elastic roller including a core having a diameter of about 10 mm and a conductive sponge layer having an outer diameter of about 16 mm resting on the core. Each of the primary transfer rollers 9Y, 9M, 9C, and 9K is adjusted to have a volume resistance in a range of $10^6$Ω to $10^{12}$Ω (preferably, $10^7$Ω to $10^9$Ω).

The driving roller 16 is located downstream from the four photoconductors 1Y, 1M, 1C, and 1K in a direction of rotation of the intermediate transfer belt 8 to contact an inner circumferential surface of the intermediate transfer belt 8 that is wound around the driving roller 16 at a winding angle of about 120 degrees. A controller 90 causes the drive motor Mt1 to drive and rotate the driving roller 16 clockwise in FIG. 3, As the driving roller 16 rotates, the intermediate transfer belt 8 travels in a given direction of rotation, which is a clockwise direction in FIG. 3.

The driven roller 17 is located upstream from the four photoconductors 1Y, 1M, 1C, and 1K in the direction of rotation of the intermediate transfer belt 8 to contact the inner circumferential surface of the intermediate transfer belt 8 that is wound around the driven roller 17 at a winding angle of about 180 degrees. A portion of the intermediate transfer belt 8 extending from the driven roller 17 to the driving roller 16 is substantially horizontal. As the intermediate transfer belt 8 travels, the driven roller 17 is rotated clockwise in FIG. 3.

The tension roller 19 contacts the outer circumferential surface of the intermediate transfer belt 8. The pre-transfer roller 18, the cleaning opposed roller 20, the lubricant facing roller 21, the backup roller 22, and the secondary transfer opposed roller 80 contact the inner circumferential surface of the intermediate transfer belt 8.

Between the secondary transfer opposed roller 80 and the lubricant facing roller 21 is the cleaning opposed roller 20 that is disposed to contact the intermediate transfer cleaner 10 (specifically, the cleaning blade) via the intermediate transfer belt 8.

Between the cleaning opposed roller 20 and the tension roller 19 is the lubricant facing roller 21 that is disposed to contact the lubricant supplier 30, serving as an intermediate transfer lubricant supply device, via the intermediate transfer belt 8. Similar to the lubricant supplier 3 for the photoconductor 1, the lubricant supplier 30 includes. e.g., a lubricant supply roller, a solid lubricant, and a compression spring. While rotating counterclockwise in FIG. 3, the lubricant supply roller gradually scrapes the solid lubricant off to supply the lubricant to the outer circumferential surface of the intermediate transfer belt 8.

The rollers 17 to 22 and 80 except the driving roller 16 are rotated along with the rotation of the intermediate transfer belt 8.

Figure 4:
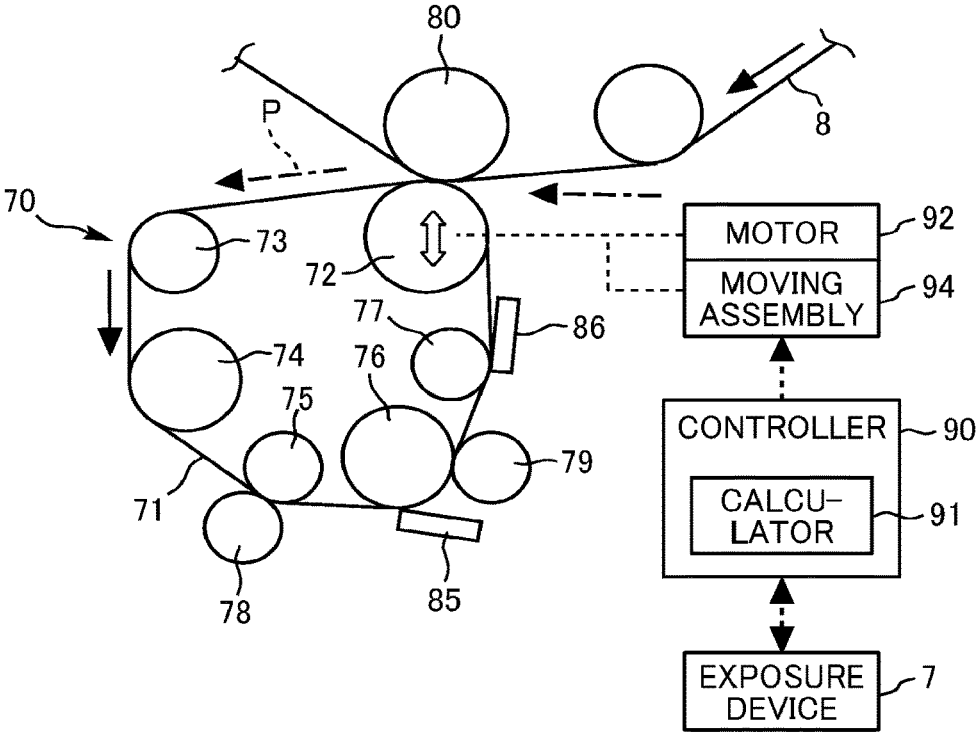
FIG. 4 is a diagram illustrating a configuration of a secondary transfer device.

Referring to FIG. 4, the secondary transfer opposed roller 80 contacts the secondary transfer roller 72 via the intermediate transfer belt 8 and the secondary transfer belt 71. The secondary transfer opposed roller 80 includes a cylindrical core made of, e.g., stainless steel and an elastic layer resting on an outer circumferential surface of the core. The elastic layer is made of nitril-butadiene rubber (NBR) having a volume resistance of about $10^7\Omega$ to about $10^8\Omega$ and a hardness (specifically, Japanese Industrial Standards (JIS)-A hardness) of about 48 degrees to about 58 degrees. The elastic layer has a thickness of about 5 mm.

In the present embodiment, as illustrated in FIG. 3, the secondary transfer opposed roller 80 is electrically connected to a power supply 93 serving as a bias output device. The power supply 93 applies a secondary transfer bias having a high voltage of about −5 kV to the secondary transfer opposed roller 80. The secondary transfer bias applied to the secondary transfer opposed roller 80 secondarily transfers a toner image, which has been primarily transferred onto the outer circumferential surface of the intermediate transfer belt 8, onto a sheet P conveyed to the secondary transfer nip. Specifically, the secondary transfer bias is a direct current (DC) voltage having a polarity identical to the polarity of toner, which is negative in the present embodiment. Accordingly, a secondary transfer electric field electrostatically moves the toner borne on a toner bearing surface (i.e., the outer circumferential surface) of the intermediate transfer belt 8 in a direction from the secondary transfer opposed roller 80 to the secondary transfer device 70.

Referring to FIG. 4, a description is given of the secondary transfer device 70. The secondary transfer device 70 includes, e.g., the secondary transfer belt 71 serving as a transfer rotator, the secondary transfer roller 72, a separation roller 73, a tension roller 74, a brush facing roller 75, a brush roller 78, a first blade facing roller 76, a first blade 85, a lubricant application roller 79, a second blade facing roller 77, and a second blade 86.

The secondary transfer belt 71 serving as a transfer rotator is an endless belt entrained around and supported by six rollers, namely, the secondary transfer roller 72, the separation roller 73, the tension roller 74, the brush facing roller 75, the first blade facing roller 76, and the second blade facing roller 77. The secondary transfer belt 71 is made of substantially the same material as the material of the intermediate transfer belt 8. The secondary transfer belt 71 serving as a transfer rotator contacts the intermediate transfer belt 8 serving as an image bearer to form the secondary transfer nip as a transfer nip. On the other hand, the secondary transfer belt 71 conveys the sheet P sent out of the secondary transfer nip.

In the present embodiment, the secondary transfer belt 71 may include an elastic layer made of, e.g., rubber as an intermediate layer.

The secondary transfer roller 72 sandwiches the intermediate transfer belt 8 and the secondary transfer belt 71 with the secondary transfer opposed roller 80 to form the secondary transfer nip between the intermediate transfer belt 8 and the secondary transfer belt 71. The secondary transfer roller 72 includes a hollow core made of, e.g., stainless steel or aluminum and an elastic layer resting (or covering) the hollow core. The elastic layer has a hardness (specifically, Asker C hardness) of about 40 degrees to about 50 degrees. The elastic layer of the secondary transfer roller 72 is a solid rubber or foam sponge rubber made of, e.g., polyurethane, ethylene-propylene-diene monomer (EPDM), or silicone having a conductive filler such as carbon dispersed or containing an ionic conductive material. In the present embodiment, the elastic layer has a volume resistance of about $10^{6.5}\Omega$ to about $10^{7.5}\Omega$ to reduce the concentration of the transfer current. In the present embodiment, the secondary transfer roller 72 is grounded.

The controller 90 causes a motor 92 to drive and rotate the secondary transfer roller 72 counterclockwise in FIG. 4. As the secondary transfer roller 72 rotates, the secondary transfer belt 71 rotates (or travels) counterclockwise in FIG. 4. Accordingly, the rollers 73 to 77 in contact with an inner circumferential surface of the secondary transfer belt 71 are rotated counterclockwise in FIG. 4. By contrast, the brush roller 78 and the lubricant application roller 79 in contact with an outer circumferential surface of the secondary transfer belt 71 are rotated clockwise FIG. 4.

Note that the motor 92 is a variable rotation speed motor. The controller 90 causes the motor 92 to adjust the number of rotations of the secondary transfer roller 72 (and the rotational speed of the secondary transfer belt 71).

A moving assembly 94 moves the secondary transfer roller 72 in directions indicated by white arrow in FIG. 4 to adjust the contact pressure (or nip pressure) at the secondary transfer nip. The moving assembly 94 is, e.g., a cam assembly that supports opposed end shaft portions of the secondary transfer roller 72.

The separation roller 73 is located downstream from the secondary transfer nip in the sheet conveying direction. The sheet P sent out from the secondary transfer nip is conveyed along the secondary transfer belt 71 traveling counterclockwise in FIG. 4. At the position of the separation roller 73, the sheet P is separated, as self-stripping or curvature separation, from the secondary transfer belt 71 curving along an outer circumference of the separation roller 73.

A cleaning bias having a polarity opposite the polarity of toner is applied to the brush roller 78 to remove the toner adhering to the outer circumferential surface of the secondary transfer belt 71.

The first blade 85 contacts the outer circumferential surface of the secondary transfer belt 71 to remove extraneous matter such as toner and paper dust adhering to the outer circumferential surface of the secondary transfer belt 71.

The lubricant application roller 79 applies a lubricant to the outer circumferential surface of the secondary transfer belt 71 to reduce wear of the first blade 85, for example.

The second blade 86 contacts the outer circumferential surface of the secondary transfer belt 71 to thin the lubricant applied to the outer circumferential surface of the secondary transfer belt 71.

Referring now to FIGS. 3 to 8, a detailed description is given of a configuration and operation of the image forming apparatus 100 according to the present embodiment.

As described above with reference to FIGS. 3 and 4, the image forming apparatus 100 includes the secondary transfer belt 71 serving as a transfer rotator that contacts the intermediate transfer belt 8 to form a transfer nip (specifically, the secondary transfer nip) between the intermediate transfer belt 8 and the secondary transfer belt 71. Note that the intermediate transfer belt 8 serves as an image bearer that bears a toner image. The secondary transfer belt 71 serving as a transfer rotator transfers a toner image from the intermediate transfer belt 8 onto a sheet P conveyed to the secondary transfer nip.

The image forming apparatus 100 further includes an adjuster that adjusts at least one of a relative difference in linear velocity of the secondary transfer belt 71 serving as a transfer rotator to the intermediate transfer belt 8 serving as an image bearer at the secondary transfer nip as a transfer nip and a relative contact pressure of the secondary transfer belt 71 to the intermediate transfer belt 8 at the secondary transfer nip.

Specifically, the adjuster is configured to adjust at least one of the rotational speed as a traveling speed of the secondary transfer belt 71 serving as a transfer rotator and the contact pressure of the secondary transfer belt 71 against the intermediate transfer belt 8 serving as an image bearer.

More specifically, the image forming apparatus 100 of the present embodiment includes the motor 92 (illustrated in FIG. 4) capable of adjusting the number of rotations of the secondary transfer roller 72. The motor 92 is a variable rotation speed motor. The controller 90 causes the motor 92 serving as an adjuster to adjust the number of rotations of the secondary transfer roller 72 to adjust the rotational speed of the secondary transfer belt 71, thus adjusting the difference in linear velocity between the secondary transfer belt 71 and the intermediate transfer belt 8 at the secondary transfer nip. That is, the controller 90 causes the motor 92 to adjust the difference in linear (L1-L2) between a linear velocity L1 of the intermediate transfer belt 8 at the secondary transfer nip and a linear velocity L2 of the secondary transfer belt 71 at the secondary transfer nip, as necessary.

The image forming apparatus 100 of the present embodiment further includes the moving assembly 94 (illustrated in FIG. 4) capable of moving the secondary transfer roller 72. The moving assembly 94 is, e.g., a cam assembly. The controller 90 causes the moving assembly 94 serving as an adjuster to adjust the vertical position of the secondary transfer roller 72 in FIG. 4 to adjust the contact pressure of the secondary transfer belt 71 against the intermediate transfer belt 8 at the secondary transfer nip. That is, the controller 90 causes the moving assembly 94 to adjust a contact pressure F as a nip pressure at the secondary transfer nip, as necessary.

As described above with reference to FIG. 1, the image forming apparatus 100 of the present embodiment further includes the sheet reversal device 40 that conveys the sheet P bearing a toner image transferred onto the front side of the sheet P toward the secondary transfer nip to transfer another toner image from the intermediate transfer belt 8 onto the back side of the sheet P at the secondary transfer nip.

The image forming apparatus 100 of the present embodiment further includes the controller 90 as circuitry. Based on a difference in image magnification in the sheet conveying direction of toner images transferred onto surfaces of one or more sheets P conveyed to the secondary transfer nip as a transfer nip, the controller 90 causes the adjuster, which is at least one of the motor 92 and the moving assembly 94, to reduce the difference in image magnification. Specifically, the difference in image magnification in the sheet conveying direction of toner images transferred onto surfaces of one or more sheets P is a difference in image magnification in the sheet conveying direction of toner images on the sheet P or the sheets P caused by a difference in image area rate of the toner images transferred onto one or more sheets P.

In other words, the image forming apparatus 100 of the present embodiment further includes the controller 90 as circuitry. Based on an amount of difference in conveyance in the sheet conveying direction of the sheet P or the sheets P caused by a difference in image area rate of toner images transferred onto surfaces of one or more sheets P conveyed to the secondary transfer nip as a transfer nip, the controller 90 causes the adjuster, which is at least one of the motor 92 and the moving assembly 94, to reduce the amount of difference in conveyance.

The "image area rate" is a proportion of an image portion (i.e., a portion where a toner image is formed) per unit area of a sheet P. Specifically, in a case in which the sheet P is blank and no image is formed, the image area rate is 0%. In a case in which a solid image is formed on the entire surface of the sheet P, the image area rate is 100%. In a case in which a halftone image is formed on the entire surface of the sheet P, the image area rate is 25%.

The "image magnification in the conveying direction" of the toner image transferred onto the surface of the sheet P is the ratio, in the sheet conveying direction, of the toner image (i.e., image) after being transferred onto the sheet P to the toner image borne on an image bearer before being transferred onto the sheet P. In other words, the "image magnification in the conveying direction" of the toner image transferred onto the surface of the sheet P is, e.g., a percentage by which the length of the image changes in the sheet conveying direction. Specifically, in the present embodiment, the "image magnification in the sheet conveying direction" is a change of length (or distance) in the sheet conveying direction of the image secondarily transferred onto the sheet P with respect to the image formed on the intermediate transfer belt 8. Therefore, the "difference in image magnification in the sheet conveying direction" of the toner images transferred onto surfaces of one or more sheets P is a difference (Z1-Z2) between an "image magnification Z1 in the sheet conveying direction" on a first sheet surface and an "image magnification Z2 in the sheet conveying direction" on a second sheet surface.

Figure 5A:
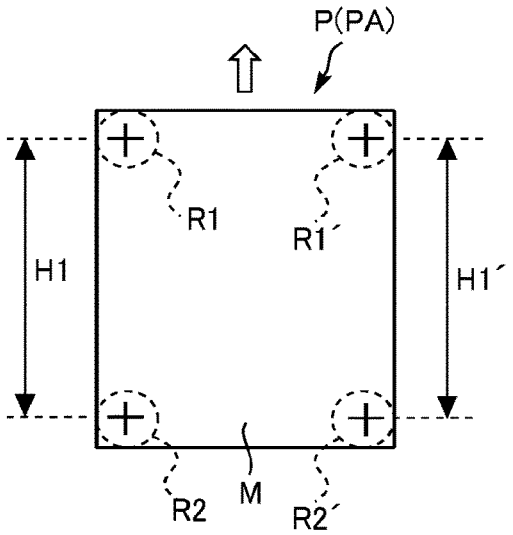
FIG. 5A is a diagram illustrating an image formed on a front side of a sheet in an adjustment mode.

Specifically, as illustrated in FIG. 5A, detection marks R1 and R2 are transferred onto different positions from each other in the sheet conveying direction on a first sheet, which is a front side PA of a single sheet P. Similarly, detection marks R1' and R2' are transferred onto different positions from each other in the sheet conveying direction on the first sheet. Note that the sheet conveying direction is a sub-scanning direction. A first image pattern M having a relatively low image area rate is also transferred onto the first sheet. A calculator 91 and the line sensor 95 serving as detectors detect, as a first distance H1, the distance between the detection marks R1 and R2 in the sheet conveying direction. Similarly, the calculator 91 and the line sensor 95 serving as detectors detect, as a first distance H1', the distance between the detection marks R1' and R2' in the sheet conveying direction.

Figure 5B:
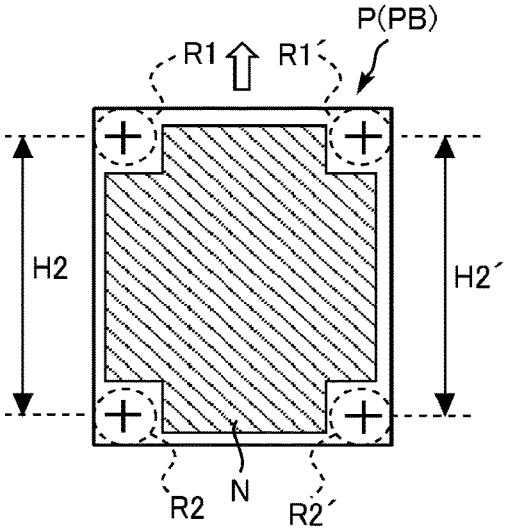
FIG. 5B is a diagram illustrating an image formed on a back side of the sheet in the adjustment mode.

As illustrated in FIG. 5B, the detection marks R1 and R2 are transferred onto different positions from each other in the sheet conveying direction on a second sheet, which is a back side PB of the single sheet P, to be located identically to the detection marks R1 and R2 on the first sheet. Similarly, the detection marks R1' and R2' are transferred onto different positions from each other in the sheet conveying direction on the second sheet to be located identically to the detection marks R1' and R2' on the first sheet. A second image pattern N having an image area rate greater than the image area rate of the first image pattern M is also transferred onto the second sheet. The calculator 91 and the line sensor 95 serving as detectors detect, as a second distance H2, the distance between the detection marks R1 and R2 in the sheet conveying direction. Similarly, the calculator 91 and the line sensor 95 serving as detectors detect, as a second distance H2', the distance between the detection marks R1' and R2' in the sheet conveying direction.

The controller 90 as circuitry causes at least one of the motor 92 and the moving assembly 94 serving as adjusters to adjust a difference in distance (H1-H2) between the first distance H1 and the second distance H2 detected by the calculator 91 and the line sensor 95 serving as detectors to be equal to or less than a given value A. Similarly, the controller 90 causes at least one of the motor 92 and the moving assembly 94 serving as adjusters to adjust a difference in distance (H1'-H2') between the first distance H1' and the second distance H2' detected by the calculator 91 and the line sensor 95 serving as detectors to be equal to or less than the given value A.

Note that, in the control described above with reference to FIGS. 5A and 5B, since a distance (H0) in the sheet conveying direction (i.e., the sub-scanning direction) between images (i.e., the detection marks R1 and R2) formed on the intermediate transfer belt 8 remains unchanged regardless of the image area rate, a change of distance (or a difference in distance) in the sheet conveying direction of the images (i.e., the detection marks R1 and R2) secondarily transferred onto the sheet P is used as a difference in image magnification, that is, a change of "image magnification in the sheet conveying direction."

In short, since there is a correlation between the difference in distance (H1-H2) described above and a difference in image magnification (H1/H0-H2/H0), the control is performed based on the difference in distance (H1-H2). In other words, the control described above is based on the difference in image magnification (H1/H0-H2/H0).

The relationship between the difference in image magnification (H1/H0-H2/H0) described here and the difference (Z1-Z2) between the "image magnification Z1 in the sheet conveying direction" on the first sheet surface (i.e., the front side PA) and the "image magnification Z2 in the sheet conveying direction" on the second sheet surface (i.e., the back side PB) described above is Z1-Z2=H1/H0-H2/H0 (where Z1=H1/H0 and Z2=H2/H0).

Such a series of control is performed at a time different from the time of normal printing (for example, at the time of warming up before the printing operation) to adjust the difference in linear velocity and the contact pressure at the secondary transfer nip so that the image magnification in the sheet conveying direction is less likely to change, regardless of the image area rate of the images formed on the sheet P at the secondary transfer nip. Such control is hereinafter referred to as "adjustment mode" as appropriate.

More specifically, in the image forming apparatus 100 of the present embodiment, the line sensor 95 is disposed downstream from the fixing device 50 (as illustrated in FIG. 1) so as to extend in the width direction (i.e., the main scanning direction). The line sensor 95 includes a plurality of photosensors arranged side by side in the width direction.

The controller 90 includes the calculator 91 (as illustrated in FIG. 4) that calculates the first distances H1 and H1' and the second distances H2 and H2', based on the information of the detection marks R1, R2, R1', and R2' optically detected by the line sensor 95.

That is, the line sensor 95 and the calculator 91 function as detectors that detect the first distances H1 and H1' and the second distances H2 and H2'. Based on the detection results, the controller 90 obtains the difference in image magnification (i.e., the amount of difference in conveyance) in the sheet conveying direction (i.e., the sub-scanning direction) of the images formed on the sheet P.

As illustrated in FIGS. 5A and 5B, in the present embodiment, the first sheet on which the first image pattern M is formed and the second sheet on which the second image pattern N is formed are the same single sheet P. In other words, the first sheet and the second sheets are the front side and the back side, respectively, of the sheet P as a single sheet. The first image pattern M is formed on the front side PA of the single sheet P; whereas the second image pattern N is formed on the back side PB of the single sheet P.

That is, in the double-sided printing mode described above with reference to FIG. 1, the detection marks R1, R2, R1', and R2' are formed on the front side PA of the single sheet P together with the first image pattern M; whereas the detection marks R1, R2, R1', and R2' are formed on the back side PB of the single sheet P together with the second image pattern N.

Figure 6:
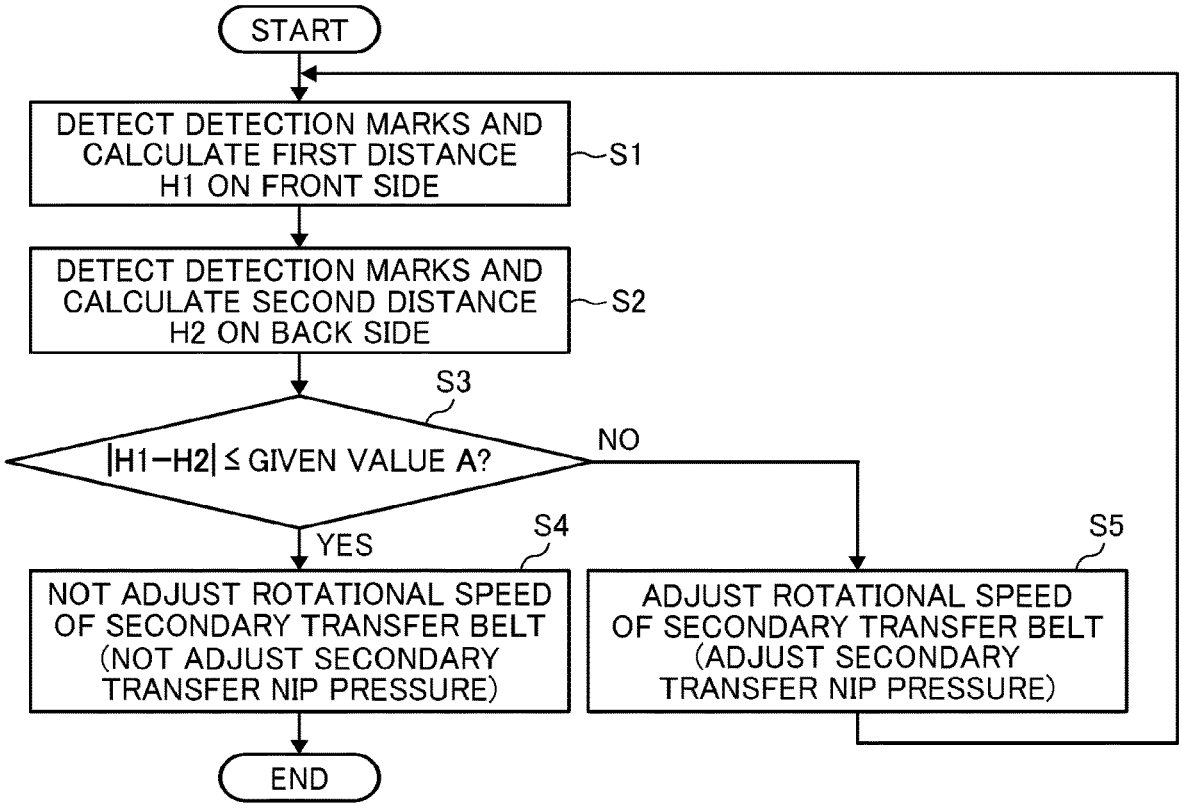
FIG. 6 is a flowchart of control in an adjustment mode.

Referring now to FIG. 6, a description is given of a series of operations in the adjustment mode.

FIG. 6 is a flowchart of control in the adjustment mode.

When the adjustment mode is executed, firstly, a single sheet P is fed from the sheet feeder 26. At the secondary transfer nip, the images illustrated in FIG. 5A (i.e., the four detection marks R1, R2, R1', and R2' and the first image pattern M) are formed on the front side PA of the sheet P. Note that the images are formed in the series of image forming processes described above.

The four detection marks R1, R2, R1', and R2' are cross-shaped images formed at the respective four corners of the sheet surface. The first image pattern M has an image area rate lower than the image area rate of the second image pattern N. In the present embodiment, the image area rate of the first image pattern M is set to 0%. That is, only the four detection marks R1, R2, R1', and R2' are formed on the front side PA.

After being subjected to the fixing process, the sheet P bearing the four detection marks R1, R2, R1', and R2' (and the first image pattern M) fixed on the front side PA reaches the position of the line sensor 95. In step S1 of FIG. 6, the line sensor 95 reads the detection marks R1 and R2 separated from each other in the sub-scanning direction (i.e. the sheet conveying direction) and the detection marks R1' and R2' separated from each other in the sub-scanning direction. The calculator 91 multiplies the difference in reading time by the conveying speed of the sheet P to obtain the first distances H1 and H1'. Note that the first distance H1 finally obtained is a mean value of the first distance H1 obtained based on the detection marks R1 and R2 on one side of the front side PA in the main scanning direction and the first distance H1' obtained based on the detection marks R1' and R2' on the other side of the front side PA in the main scanning direction.

Thereafter, the sheet P bearing the four detection marks R1, R2, R1', and R2' (and the first image pattern M) on the front side PA is conveyed to the secondary transfer nip again by the sheet reversal device 40. At the secondary transfer nip, the images illustrated in FIG. 5B (i.e., the four detection marks R1, R2, R1', and R2' and the second image pattern N) are formed on the back side PB of the sheet P. Note that the images are formed in the series of image forming processes described above.

Like the four detection marks R1, R2, R1', and R2' illustrated in FIG. 5A, the four detection marks R1, R2, R1', and R2' illustrated in FIG. 5B are cross-shaped images formed at the respective four corners of the sheet surface. The second image pattern N has an image area rate higher than the image area rate of the first image pattern M. In the present embodiment, the image area rate of the second image pattern N is set to 25% or greater. In particular, in the present embodiment, the second image pattern N is a half-tone image having an image area rate of 25%. The second image pattern N is formed at a position excluding the four detection marks R1, R2, R1', and R2' and the surroundings of the four detection marks R1, R2, R1', and R2'.

After being subjected to the fixing process, the sheet P bearing the four detection marks R1, R2, R1', and R2' (and the second image pattern N) fixed on the back side PB reaches the position of the line sensor 95. In step S2 of FIG. 6, the line sensor 95 reads the detection marks R1 and R2 separated from each other in the sub-scanning direction (i.e. the sheet conveying direction) on the back side PB and the detection marks R1' and R2' separated from each other in the sub-scanning direction on the back side PB. The calculator 91 multiplies the difference in reading time by the conveying speed of the sheet P to obtain the second distances H2 and H2'. Note that the second distance H2 finally obtained is a mean value of the second distance H2 obtained based on the detection marks R1 and R2 on one side of the back side PB in the main scanning direction and the second distance H2' obtained based on the detection marks R1' and R2' on the other side of the back side PB in the main scanning direction.

In step S3 of FIG. 6, the controller 90 determines whether the difference in distance (|H1-H2|) between the first distance H1 and the second distance H2 is equal to or less than the given value A. Note that the given value A is a value preset based an allowable value of the difference in image magnification.

When the controller 90 determines that the difference in distance (|H1-H2|) is equal to or less than the given value A (YES in step S3), the controller 90 determines that the difference in image area rate is less likely to cause unfavorable changes of image magnification in the sheet conveying direction. In step S4 of FIG. 6, the controller 90 does not adjust the rotational speed of the secondary transfer belt 71 or the contact pressure (i.e., the nip pressure) at the secondary transfer nip. Thus, the adjustment mode is completed. By contrast, when the controller 90 determines that the difference in distance (|H1-H2|) is greater than the given value A (NO in step S3), the controller 90 determines that the difference in image area rate is likely to cause unfavorable changes of image magnification in the sheet conveying direction. In step S5 of FIG. 6, the controller 90 adjusts at least one of the rotational speed of the secondary transfer belt 71 and the contact pressure (i.e., the nip pressure) at the secondary transfer nip. Then, the flow is repeated from step S1. Each time the flow is repeated from step S1, another sheet P for adjustment is fed from the sheet feeder 26.

Note that, in the adjustment mode, either the rotational speed of the secondary transfer belt 71 or the contact pressure (i.e., the nip pressure) at the secondary transfer nip may be adjusted. Alternatively, both the rotational speed of the secondary transfer belt 71 and the contact pressure (i.e., the nip pressure) at the secondary transfer nip may be adjusted.

In the embodiment, the rotational speed of the secondary transfer belt 71 serving as a transfer rotator is adjusted to adjust the relative difference in linear velocity of the secondary transfer belt 71 to the intermediate transfer belt 8 serving as an image bearer at the secondary transfer nip. On the other hand, the traveling speed of the intermediate transfer belt 8 is adjusted or the respective speeds of the secondary transfer belt 71 and the intermediate transfer belt 8 are adjusted to adjust the relative difference in linear velocity of the secondary transfer belt 71 to the intermediate transfer belt 8 at the secondary transfer nip.

Now, a description is given of a mechanism in which the image magnification in the sheet conveying direction changes due to the difference in the image area rate of the images transferred at the secondary transfer nip, and a mechanism in which such unfavorable changes of image magnification is eliminated by the adjustment performed by the adjusters.

When passing through the secondary transfer nip as a transfer nip, the sheet P may follow the speed (or linear velocity) of either the intermediate transfer belt 8 serving as an image bearer or the secondary transfer belt 71 serving as a transfer rotator. However, at this time, the friction state of the surface of the sheet P changes depending on the image area rate of the images transferred onto the sheet P. That is, the friction state of the intermediate transfer belt 8 and the secondary transfer belt 71 with respect to the sheet P at the secondary transfer nip changes depending on the image area rate, thus changing the conveying speed (or amount) of the sheet P, resulting in a difference in sub-scanning magnification, that is, image magnification in the sheet conveying direction.

Such a difference in image magnification (i.e., an amount of difference in conveyance) in the sheet conveying direction can be reduced by adjusting at least one of the contact pressure (i.e., the nip pressure) between the intermediate transfer belt 8 and the secondary transfer belt 71 at the secondary transfer nip and the difference in linear velocity between the intermediate transfer belt 8 and the secondary transfer belt 71.

This is because the conveying speed (or amount) of the sheet P varies depending on the rotational speed (or linear velocity) of the intermediate transfer belt 8, the rotational speed (or linear velocity) of the secondary transfer belt 71, and the contact pressure at the secondary transfer nip.

A detailed description is now given to provide a fuller understanding of the situation. At the secondary transfer nip, when the frictional force between the sheet P and the intermediate transfer belt 8 is greater than the frictional force between the sheet P and the secondary transfer belt 71, the sheet P is conveyed at a speed close to the linear velocity of the intermediate transfer belt 8. By contrast, when the frictional force between the sheet P and the intermediate transfer belt 8 is less than the frictional force between the sheet P and the secondary transfer belt 71, the sheet P is conveyed at a speed close to the linear velocity of the secondary transfer belt 71.

When the contact pressure (i.e., the nip pressure) increases at the secondary transfer nip, the shape of the secondary transfer nip changes. For example, when the nip pressure increases, the secondary transfer roller 72 and the secondary transfer opposed roller 80 are deformed (or only the softer one of the secondary transfer roller 72 and the secondary transfer opposed roller 80 is deformed) at the secondary transfer nip, which is formed between the secondary transfer belt 71 and the intermediate transfer belt 8 by the secondary transfer roller 72 and the secondary transfer opposed roller 80. Such deformation changes the posture of the sheet P at the secondary transfer nip and therefore changes the friction state between the sheet P and the secondary transfer belt 71 and the friction state between the sheet P and the intermediate transfer belt 8. As a result, the conveying speed of the sheet P fluctuates.

The state of friction also changes when the sheet P bears toner. The toner borne on the sheet P reduces the friction coefficient of the sheet surface, resulting in easy slippage between the sheet P and the intermediate transfer belt 8 or between the sheet P and the secondary transfer belt 71. Therefore, the sheet P bearing no image and the sheet P bearing a solid image may be different from each other in the conveying speed (or amount) of the sheet P at the secondary transfer nip. Such a difference causes a difference in image magnification in the sheet conveying direction depending on the image area rate.

Figure 7A:
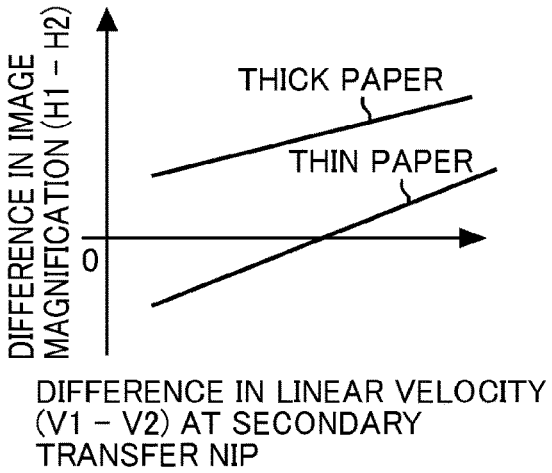
FIG. 7A is a graph illustrating a relationship between a difference in linear velocity and a difference in image magnification at a secondary transfer nip.

FIG. 7A is a graph illustrating, on the horizontal axis, a difference in linear velocity (V1-V2) between a linear velocity V1 of the intermediate transfer belt 8 and a linear velocity V2 of the secondary transfer belt 71 while illustrating, on the vertical axis, a difference in image magnification (the first distance H1-the second distance H2) in the sheet conveying direction between when an image is output at a low image area rate and when an image is output at a high image area rate. The contact pressure F is constant at the secondary transfer nip. FIG. 7A illustrates that, as the difference in linear velocity (V1-V2) changes, the friction state changes as described above, resulting in a change of the difference in image magnification (H1-H2). In a relation of H1>H2, as the difference in linear velocity (V1-V2) decreases, the difference in image magnification (H1-H2) also decreases. Such a phenomenon is common regardless of the thickness of the sheet P (i.e., whether the sheet P is thin or thick).

Figure 7B:
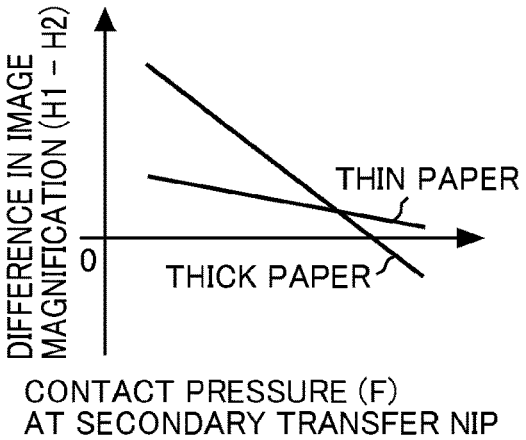
FIG. 7B is a graph illustrating a relationship between a contact pressure and the difference in image magnification at the secondary transfer nip.

By contrast, FIG. 7B is a graph illustrating, on the horizontal axis, the contact pressure F (i.e., the nip pressure) at the secondary transfer nip while illustrating, on the vertical axis, the difference in image magnification (the first distance H1-the second distance H2) in the sheet conveying direction between when an image is output at a low image area rate and when an image is output at a high image area rate. The difference in linear velocity (V1-V2) is constant at the secondary transfer nip. FIG. 7B illustrates that, as the contact pressure F changes, the friction state changes as described above, resulting in a change of the difference in image magnification (H1-H2). In the relation of H1>H2, as the contact pressure F increases, the difference in image magnification (H1-H2) decreases. Such a phenomenon is common regardless of the thickness of the sheet P (i.e., whether the sheet P is thin or thick).

The adjustment mode in the present embodiment is performed based on the aforementioned phenomena.

In a typical image forming apparatus, when toner images formed on an image bearer are individually transferred onto a surface of a sheet conveyed to a transfer nip, the toner images may be transferred by different image magnifications in a sheet conveying direction in which the sheet is conveyed, depending on the image area rate of the toner images. Even when characteristic values such as the rotational speed of the transfer rotator are determined, with respect to a given image area rate, so that the image magnification of the transferred image is equal to or less than a threshold, a toner image having an image area rate different from the given image area rate may be transferred onto a sheet with the image magnification greater than the threshold. As a result, an image expanded or contracted in the sheet conveying direction may be formed.

To address such a situation, according to the present embodiment, the adjustment mode is performed at a given time as described above. Specifically, in the adjustment mode, based on a difference in image magnification (i.e., an amount of difference in conveyance) caused by a difference in the image area rate of images formed on the sheet P at the secondary transfer nip, at least one of the difference in linear velocity and the contact pressure is adjusted at the secondary transfer nip to reduce the difference in image magnification (i.e., the amount of difference in conveyance).

Accordingly, the image magnification in the sheet conveying direction is optimized regardless of the image area rate of the toner images transferred onto surfaces of one or more sheets P conveyed to the secondary transfer nip. That is, in the present embodiment, the difference in image magnification (i.e., the amount of difference in conveyance) is reduced when the images are output at different image area rates, as compared with a case in which, e.g., the rotational speed of a secondary transfer belt is adjusted so that the image magnification of the transferred image is equal to or less than a threshold with respect to a given image area rate. Accordingly, the present embodiment addresses an unfavorable situation in which an image is formed while being expanded or contracted in the sheet conveying direction, regardless of different image area rates.

In particular, in a case in which at least one of the intermediate transfer belt 8 serving as an image bearer and the secondary transfer belt 71 serving as a transfer rotator is an elastic belt having an elastic layer, the configuration of the present embodiment is advantageous because a difference in image magnification (i.e., an amount of difference in conveyance) is likely to be generated between transferred images having different image area rates from each other.

In the present embodiment, the first image pattern M is formed at a low image area rate on the front side of a single sheet P; whereas the second image pattern N is formed at a high image area rate on the back side of the sheet P. The detection marks R1, R2, R1', and R2' are formed on each side of the sheet P and detected. Thus, the adjustment mode is performed. Therefore, the consumption of the sheet P is reduced in the present embodiment, as compared with a case in which the first image pattern M is formed at a low image area rate on a sheet P (as a first sheet P); whereas the second image pattern N is formed at a high image area rate on another sheet P (as a second sheet P), and the detection marks R1, R2, R1', and R2' are detected for each of the first and second sheets P in the adjustment mode.

In the present embodiment, the image area rate of the second image pattern N is set to 25%. As the image area rate increases, the sheet P may slip at the secondary transfer nip. However, when the image area rate is 25% or more, there is no large change of the degree of slippage of the sheet P (i.e., the effect of friction is saturated). To reduce the toner consumption in a state in which a large slippage of the sheet P is likely to occur, the image area rate of the second image pattern N is set to 25% in the present embodiment.

In the present embodiment, after executing the adjustment mode, the controller 90 adjusts a writing timing and an exposure distribution of the exposure device 7 for each of the main scanning direction and the sub-scanning direction.

Figure 8:
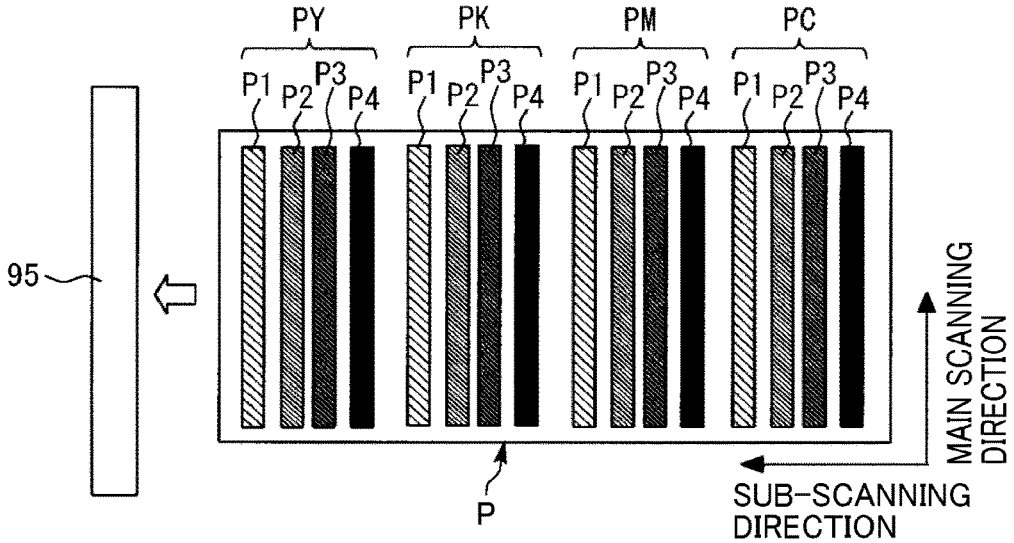
FIG. 8 is a schematic top view of a line sensor and a sheet on which a gradation image pattern is formed.

Specifically, after the adjustment mode described above with reference to FIG. 6 is completed, gradation patterns PY, PK, PM, and PC are formed on a sheet P in the series of the image forming processes as illustrated in FIG. 8. The sheet P bearing the gradation patterns PY, PK, PM, and PC is conveyed to the position of the line sensor 95, which reads the gradation patterns PY, PK, PM, and PC.

The gradation image patterns PY, PK, PM, and PC for yellow, magenta, cyan, and black, respectively, have identical image densities in the main scanning direction and stepwise different image densities in the sub-scanning direction. More specifically, the gradation image pattern PY formed in yellow, the gradation image pattern PK formed in black, the gradation image pattern PM formed in magenta, and the gradation image pattern PC formed in cyan are formed on a single sheet P (as an adjustment sheet) at a time different from the time of normal image forming operation. Each of the gradation image patterns PY, PK, PM, and PC of the four colors includes four strip-shaped gradated image patterns P1 to P4 formed at identical image densities (or image area rates) in the main scanning direction and at intervals in the sub-scanning direction. The gradated image patterns P1 to P4 are formed so that the respective image densities (or image area rates) are stepwise different from each other. Specifically, the image density (or image area rate) of the gradated image patterns P1, P2, P3, and P4 increases in this order. More specifically, the gradated image patterns P1 has an image density (or image area rate) of 20%. The gradated image patterns P2 has an image density (or image area rate) of 40%. The gradated image patterns P3 has an image density (or image area rate) of 70%. The gradated image patterns P4 has an image density (or image area rate) of 100%.

The line sensor 95 detects the respective positions of the gradation image patterns PY, PK, PM, and PC for each of the main scanning direction and the sub-scanning direction. Based on the detection results, the writing timing is adjusted for the exposure device 7 for each color and for each of the main scanning direction and the sub-scanning direction. The line sensor 95 also detects the respective image densities of the gradation image patterns PY, PK, PM, and PC. Based on the detection results, the exposure distribution is adjusted for the exposure device 7 for each color and for each of the main scanning direction and the sub-scanning direction.

Note that such adjustments are also performed when the gradation image patterns PY, PK, PM, and PC are formed and printed on the back side of the sheet P.

Thus, an adjustment method for the image forming apparatus 100 or an adjustment method performed by the image forming apparatus 100 (i.e., an image forming method for the image forming apparatus 100) includes: (1) transferring a first toner image (e.g., the first image pattern M) and a second toner image (e.g., the second image pattern N) having an image area rate different from an image area rate of the first toner image onto a front side (e.g., the front side PA) and a back side (e.g., the back side PB), respectively, of a sheet (e.g., the sheet P) conveyed to a transfer nip (e.g., the secondary transfer nip) (or onto a surface of a first sheet and a surface of a second sheet, respectively, the first sheet and the second sheet being conveyed to the transfer nip); and (2) causing, based on a difference in image magnification, in a direction of conveyance of the sheet or in a direction of conveyance of the first sheet and the second sheet, of toner images (e.g., the detection marks R1, R2, R1', and R2') on the front side of the sheet (or on the first sheet) bearing the first toner image and toner images (e.g., the detection marks R1, R2, R1', and R2') on the back side of the sheet (or on the second sheet) bearing the second toner image, the adjuster (e.g., the motor 92, the moving assembly 94) to reduce the difference in image magnification.

Figure 9:
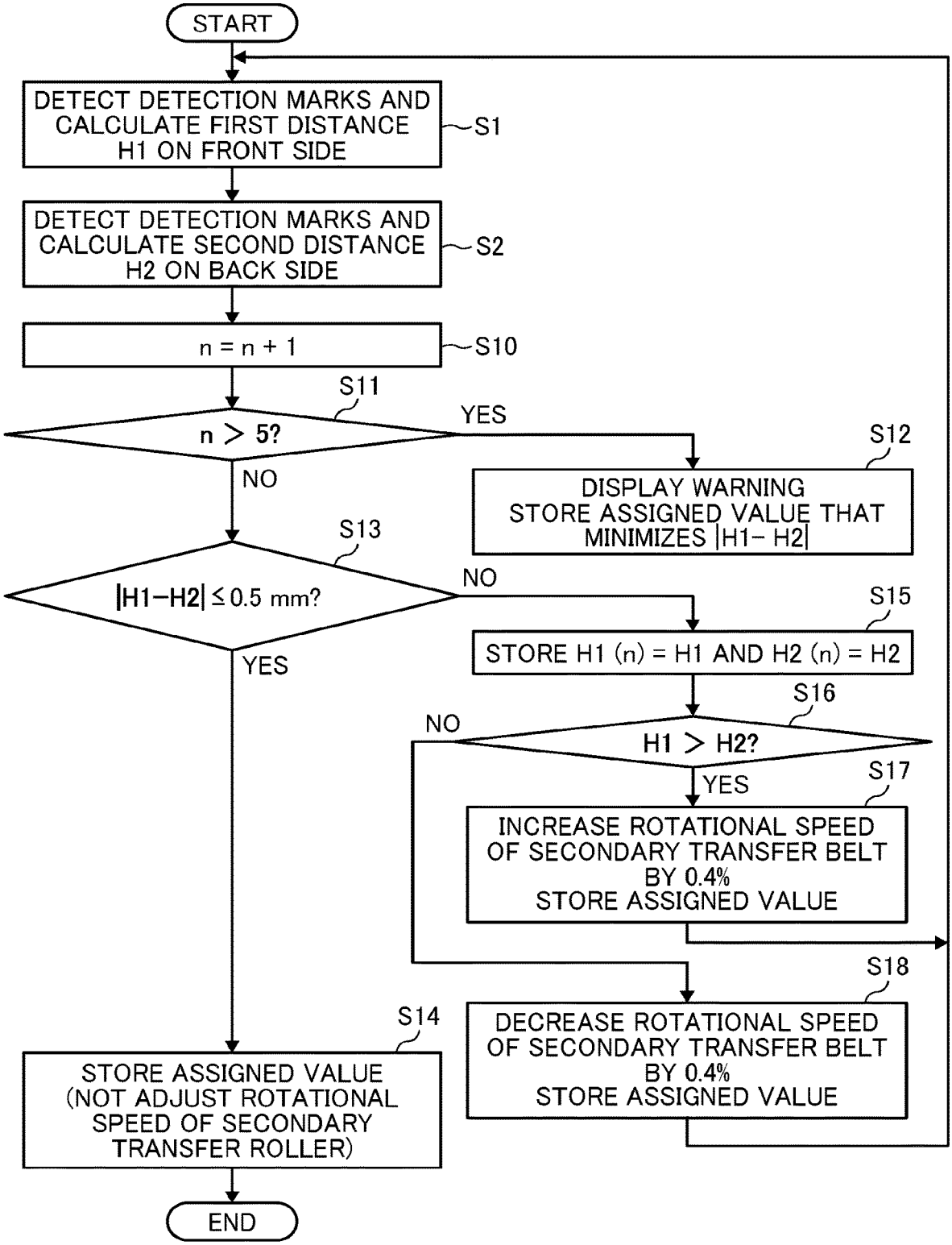
FIG. 9 is a flowchart of control in an adjustment mode according to a first variation.

Referring now to FIG. 9, a description is given of a first variation of the embodiment described above.

In the image forming apparatus 100 according to the first variation, in a case in which the difference in distance (|H1-H2|) between the first distance H1 and the second distance H2 detected by the line sensor 95 and the calculator 91 serving as detectors exceeds the given value A and in a case in which the first distance H1 is greater than the second distance H2 (i.e., H1>H2), the controller 90 as circuitry causes at least one of the motor 92 and the moving assembly 94 serving as adjusters to increase at least one of the rotational speed of the secondary transfer belt 71 and the contact pressure at the secondary transfer nip.

By contrast, in a case in which the difference in distance (|H1-H2|) between the first distance H1 and the second distance H2 detected by the line sensor 95 and the calculator 91 serving as detectors exceeds the given value A and in a case in which the first distance H1 is equal to or less than the second distance H2 (i.e., H1<H2), the controller 90 causes at least one of the motor 92 and the moving assembly 94 serving as adjusters to decrease at least one of the rotational speed of the secondary transfer belt 71 and the contact pressure at the secondary transfer nip.

The controller 90 controls at least one of the motor 92 and the moving assembly 94 serving as adjusters as described above to attain fine adjustment according to the magnitude relationship between the first distance H1 and the second distance H2 in the adjustment mode.

In addition, in the first variation, in a case in which the difference in distance (|H1-H2|) is not equal to or less than the given value A after the controller 90 as circuitry executes a given number of times (e.g., five times in the first variation) of adjustment mode to control at least one of the motor 92 and the moving assembly 94 serving as adjustors based on the difference in distance (|H1-H2|), the controller 90 displays a warning on a display panel 200 serving as a display (illustrated in FIG. 1). Specifically, the controller 90 cancels the adjustment mode and displays, on the display panel 200, a warning indicating that the adjustment mode has ended in failure.

The controller 90 controls at least one of the motor 92 and the moving assembly 94 serving as adjusters as described above to prevent an unfavorable situation in which the adjustment mode is continued indefinitely.

FIG. 9 is a flowchart of control in the adjustment mode according to the first variation.

Firstly, in step S1, the line sensor 95 reads the detection marks R1, R2, R1', and R2' formed on the front side PA of a sheet P. The calculator 91 obtains the first distance H1 based on the information from the line sensor 95.

Next, in step S2, the line sensor 95 detects the detection marks R1, R2, R1', and R2' formed on the back side PB of the sheet P. The calculator 91 obtains the second distance H2 based on the information from the line sensor 95.

Thereafter, in step S10, a counter of the controller 90 counts up the number of times "n" the adjustment mode is repeated. In step S11, the controller 90 determines whether the number of times "n" is greater than 5, which is a given number of times. When the controller 90 determines that the adjustment mode is repeated more than five times, that is, when the number of times "n" is greater than 5 (YES in step S11), the controller 90 determines that the adjustment mode has ended in failure. In step S12, the controller 90 displays a warning on the display panel 200 and stores an assigned value of the rotational speed of the secondary transfer belt 71 (or the contact pressure at the secondary transfer nip), the assigned value minimizing the difference in distance (|H1-H2|). The subsequent printing operation is executed based on the assigned value thus stored.

By contrast, when the controller 90 determines that the adjustment mode is repeated five times or less, that is, when the number of times "n" is not greater than 5 (NO in step S11), in step S13, the controller 90 determines whether the difference in distance (|H1-H2|) obtained from the results in steps S1 and S2 is equal to or less than 0.5 mm. When the controller 90 determines that the difference in distance (|H1-H2|) is equal to or less than 0.5 mm (YES in step S13), the controller 90 determines that the difference in image area rate does not cause a problematic difference in image magnification. In step S14, the controller 90 stores an assigned value of the rotational speed of the secondary transfer belt 71 (or the contact pressure at the secondary transfer nip) at the time, without adjusting the rotational speed of the secondary transfer belt 71 (or the contact pressure at the secondary transfer nip). The subsequent printing operation is executed based on the assigned value thus stored.

By contrast, when the controller 90 determines that the difference in distance (|H1-H2|) is greater than 0.5 mm (NO in step S13), in step S15, the controller 90 stores the first distance H1 and the second distance H2 at the time (i.e., H1 (*n*)=H1, H2 (*n*)=H2). In step S16, the controller 90 determines whether the first distance H1 is greater than the second distance H2. When the controller 90 determines that the first distance H1 is greater than the second distance H2 (YES in step S16), the controller 90 determines that the difference in the image area rate causes a problematic difference in image magnification and that the linear velocity V2 of the secondary transfer belt 71 has decreased. In step S17, the controller 90 increases the rotational speed of the secondary transfer belt 71 by 0.4% and stores an assigned value of the rotational speed of the secondary transfer belt 71 at the time. Then, the flow is repeated from step S1.

By contrast, when the controller 90 determines that the first distance H1 is not greater than the second distance H2 (NO in step S16), the controller 90 determines that the difference in the image area rate causes a problematic difference in image magnification and that the linear velocity V2 of the secondary transfer belt 71 has increased. In step S18, the controller 90 decreases the rotational speed of the secondary transfer belt 71 by 0.4% and stores an assigned value of the rotational speed of the secondary transfer belt 71 at the time. Then, the flow is repeated from step S1.

Note that, in a case in which the control flow of FIG. 9 is repeated, when neither H1 (*n*)-H2 (*n*) nor H1 (n+1)-H2 (n+1) satisfies the condition of step S13 and the magnitude relationship of step S16 is reversed, the rotational speed of the secondary transfer belt 71 is slightly adjusted.

Figure 10:
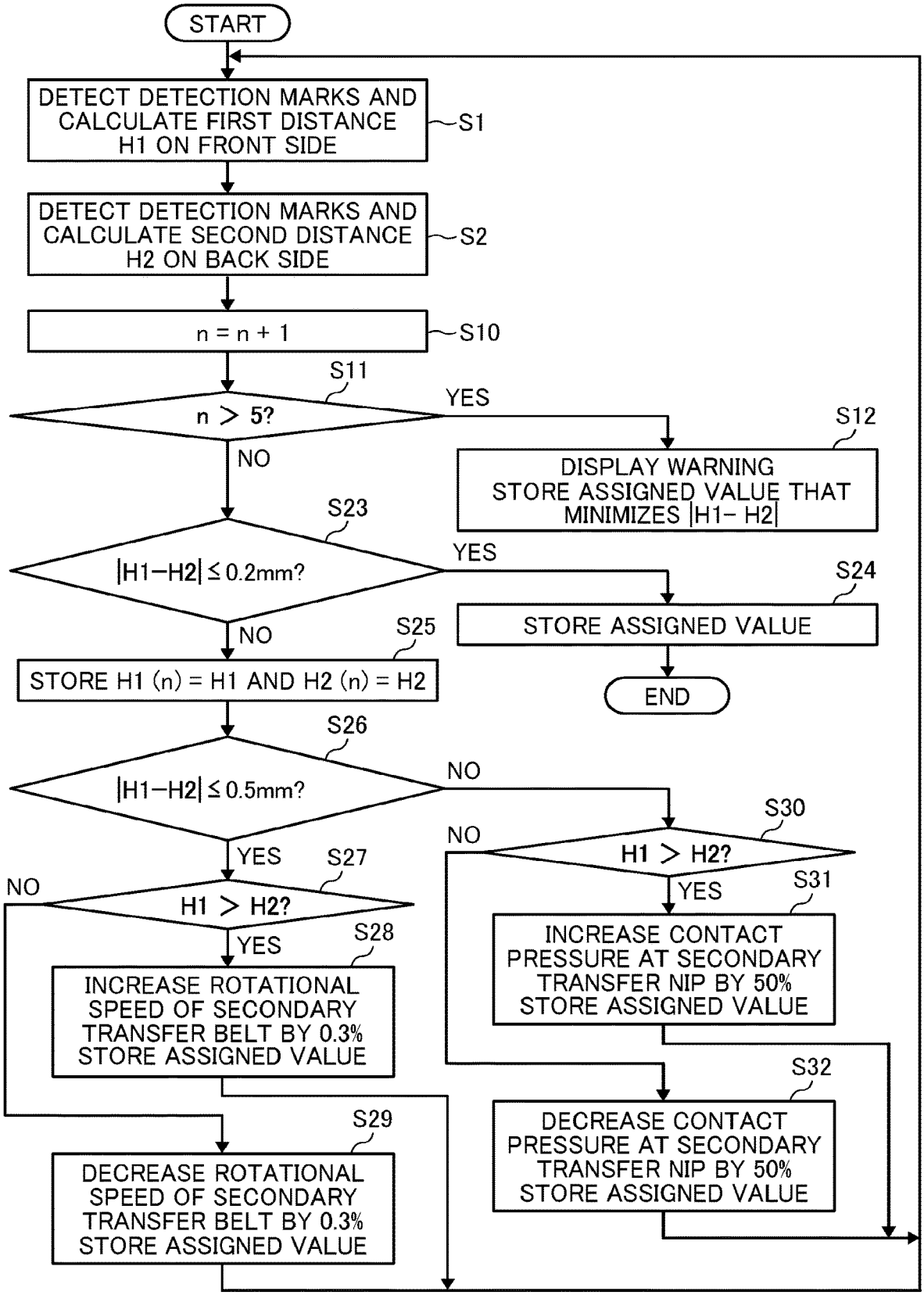
FIG. 10 is a flowchart of control in an adjustment mode according to a second variation.

Referring now to FIG. 10, a description is given of a second variation of the embodiment described above.

In the image forming apparatus 100 according to the second variation, in a case in which the difference in distance (|H1-H2|) as a difference in image magnification (i.e., an amount of difference in conveyance) is greater than a given amount B, the controller 90 as circuitry causes the moving assembly 94 serving as an adjuster to adjust the contact pressure F. By contrast, in a case in which the difference in distance (|H1-H2|) as a difference in image magnification is equal to or less than the given amount B, the controller 90 causes the motor 92 serving as an adjuster to adjust the difference in linear velocity at the secondary transfer nip. That is, in the adjustment mode, the controller 90 causes the moving assembly 94 to adjust the contact pressure for rough adjustment of the difference in image magnification. On the other hand, the controller 90 causes the motor 92 to adjust the difference in linear velocity for fine adjustment of the difference in image magnification.

This is because the adjustment of the contact pressure at the secondary transfer nip increases the amount of adjustment of the difference in image magnification with respect to the amount of change, compared with the adjustment of the difference in linear velocity at the secondary transfer nip.

Such control enhances the efficiency of the adjustment mode.

FIG. 10 is a flowchart of control in the adjustment mode according to the second variation.

The flow from step S1 to step S12 illustrated in FIG. 10 is substantially the same as the flow from step S1 to step S12 illustrated in FIG. 9. As illustrated in FIG. 10, when the controller 90 determines that adjustment mode is repeated five times or less, that is, when the number of times "n" is not greater than 5 (NO in step S11), in step S23, the controller 90 determines whether the difference in distance (|H1-H2|) obtained from the results in steps S1 and S2 is equal to or less than 0.2 mm. When the controller 90 determines that the difference in distance (|H1-H2|) is equal to or less than 0.2 mm (YES in step S23), the controller 90 determines that the difference in image area rate is less likely to cause a problematic difference in image magnification. In step S24, the controller 90 stores assigned values of the rotational speed of the secondary transfer belt 71 and the contact pressure at the time, without adjusting the rotational speed of the secondary transfer belt 71 or the contact pressure at the secondary transfer nip. The subsequent printing operation is executed based on the assigned values thus stored.

By contrast, when the controller 90 determines that the difference in distance (|H1-H2|) is greater than 0.2 mm (NO in step S23), in step S25, the controller 90 stores the first distance H1 and the second distance H2 at the time (i.e., H1 (*n*)=H1, H2 (*n*)=H2). In step S26, the controller 90 determines whether the difference in distance (|H1-H2|) obtained from the results in steps S1 and S2 is equal to or less than 0.5 mm. When the controller 90 determines that the difference in distance (H1-H2|) is equal to or less than 0.5 mm (YES in step S26), in step S27, the controller 90 determines whether the first distance H1 is greater than the second distance H2. When the controller 90 determines that the first distance H1 is greater than the second distance H2 (YES in step S27), the controller 90 determines that it is preferable to finely adjust the difference in image magnification caused by the difference in image area rate and that the linear velocity V2 of the secondary transfer belt 71 has decreased. In step S28, the controller 90 increases the rotational speed of the secondary transfer belt 71 by 0.3% and stores an assigned value of the rotational speed of the secondary transfer belt 71 at the time. Then, the flow is repeated from step S1.

By contrast, when the controller 90 determines that the first distance H1 is not greater than the second distance H2 (NO in step S27), the controller 90 determines that it is preferable to finely adjust the difference in image magnification caused by the difference in image area rate and that the linear velocity V2 of the secondary transfer belt 71 has increased. In step S29, the controller 90 decreases the rotational speed of the secondary transfer belt 71 by 0.3% and stores an assigned value of the rotational speed of the secondary transfer belt 71 at the time. Then, the flow is repeated from step S1.

On the other hand, when the controller 90 determines that the difference in distance (|H1-H2|) is greater than 0.5 mm (NO in step S26), in step S30, the controller 90 determines whether the first distance H1 is greater than the second distance H2. When the controller 90 determines that the first distance H1 is greater than the second distance H2 (YES in step S30), the controller 90 determines that it is preferable to roughly adjust the difference in image magnification caused by the difference in image area rate and that the contact pressure F has decreased at the secondary transfer nip. In step S31, the controller 90 increases the contact pressure F at the secondary transfer nip by 50% and stores an assigned value of the contact pressure F at the time. Then, the flow is repeated from step S1.

By contrast, when the controller 90 determines that the first distance H1 is not greater than the second distance H2 (NO in step S30), the controller 90 determines that it is preferable to roughly adjust the difference in image magnification caused by the difference in image area rate and that the contact pressure F has increased at the secondary transfer nip. In step S32, the controller 90 decreases the contact pressure F at the secondary transfer nip by 50% and stores an assigned value of the contact pressure F at the time. Then, the flow is repeated from step S1.

As described above, according to the embodiment and the variations described above, the image forming apparatus 100 includes the intermediate transfer belt 8 and the secondary transfer belt 71 that contacts the intermediate transfer belt 8 to form the secondary transfer nip as a transfer nip between the secondary transfer belt 71 and the intermediate transfer belt 8. The intermediate transfer belt 8 serves as an image bearer that is configured to bear a toner image. The secondary transfer belt 71 serves as a transfer rotator that is configured to transfer the toner image from the intermediate transfer belt 8 onto a sheet P conveyed to the secondary transfer nip. The image forming apparatus 100 further includes an adjuster (e.g., the motor 92, the moving assembly 94) that is configured to adjust at least one of a relative difference in linear velocity of the secondary transfer belt 71 to the intermediate transfer belt 8 at the secondary transfer nip and a relative contact pressure of the secondary transfer belt 71 to the intermediate transfer belt 8 at the secondary transfer nip. The image forming apparatus 100 further includes circuitry (e.g., the controller 90). Based on a difference in image magnification, in a direction of conveyance of the sheet, of toner images transferred onto surfaces of one or more sheets P conveyed to the secondary transfer nip, the circuitry causes the adjuster (e.g., the motor 92, the moving assembly 94) to reduce the difference in image magnification.

Such a configuration reduces changes of image magnification in the direction of conveyance of the sheet, regardless of the image area rate of the toner images transferred onto surfaces of one or more sheets P conveyed to the secondary transfer nip.

Note that, in the embodiment and the variations described above, the image forming apparatus 100 employs a repulsive transfer system in which the power supply 93 is configured to apply the secondary transfer bias to the secondary transfer opposed roller 80. Alternatively, an image forming apparatus according to an embodiment or variation may employ an attractive transfer system in which a power supply is configured to apply the secondary transfer bias to the secondary transfer roller 72. In the image forming apparatus employing the attractive transfer type, the secondary transfer bias has a polarity opposite the polarity of the secondary transfer bias applied in the image forming apparatus 100 employing the repulsive transfer system. Alternatively, an image forming apparatus according to an embodiment or variation may employ the repulsive transfer system and the attractive transfer system in combination.

In the embodiment and the variations described above, the image forming apparatus 100 includes the secondary transfer belt 71 as a transfer rotator. Alternatively, an image forming apparatus according to an embodiment or variation may include a secondary transfer roller as a transfer rotator.

In the embodiment and the variations described above, the image forming apparatus 100 includes the intermediate transfer belt 8 as an image bearer and an intermediate transferor and the secondary transfer belt 71 as a transfer rotator. Alternatively, an image forming apparatus according to an embodiment or variation may employ a so-called direct transfer system without the intermediate transferor such as an intermediate transfer belt or an intermediate transfer drum. The image forming apparatus employing the direct transfer system includes a photoconductive drum (or a drum-shaped photoconductor) serving as an image bearer and a transfer rotator that contacts the photoconductive drum to form a transfer nip between the transfer rotator and the photoconductive drum and transfers a toner image from the photoconductive drum to a sheet conveyed to the transfer nip. The transfer rotator is, e.g., a transfer roller or a transfer belt supported by a plurality of rollers.

In the present embodiment, the image forming apparatus 100 forms color images. Alternatively, an image forming apparatus according to an embodiment or variation may form only monochrome images.

Any of the cases described above exhibits substantially the same advantages as the advantages of the embodiment and the variations described above.

In the embodiment and the variations described above, the adjuster is configured to adjust the rotational speed of the secondary transfer belt 71 (i.e., the transfer rotator) to adjust the relative difference in linear velocity of the secondary transfer belt 71 to the intermediate transfer belt 8 (i.e., the image bearer) at the transfer nip. Alternatively, according to an embodiment or variation, the adjuster may be configured to adjust the rotational speed of the image bearer (or the respective rotational speeds of the image bearer and the transfer rotator) to adjust the relative difference in linear velocity of the transfer rotator to the image bearer at the transfer nip.

In the embodiment and the variations described above, the adjuster is configured to move the secondary transfer belt 71 (i.e., the transfer rotator) to adjust the relative contact pressure of the secondary transfer belt 71 to the intermediate transfer belt 8 (i.e., the image bearer) at the transfer nip. Alternatively, according to an embodiment or variation, the adjuster may be configured to move the image bearer (or the image bearer and the transfer rotator) to adjust the relative contact pressure of the transfer rotator to the image bearer at the transfer nip.

In the embodiment and the variations described above, the line sensor 95 detects the detection marks R1, R2, R1', and R2'. The sensor for detecting the detection marks R1, R2, R1', and R2' is not limited to the line sensor 95. Alternatively, for example, photosensors may be disposed at positions facing the detection marks R1, R2, R1', and R2' in a width direction of the sheet, in other words, facing opposed widthwise sides of the sheet. With the photosensors, the line sensor 95 may detect the detection marks R1, R2, R1', and R2'.

In the embodiment and the variations described above, the first image pattern M has an image area rate of 0%; whereas the second image pattern N has an image area rate of 25%. The image area rate of the first image pattern M and the image area rate of the second image pattern N are not limited to 0% and 25%, respectively. The respective image area rates of the first image pattern M and the second image pattern N may be other percentages provided that image area rate of the first image pattern M is different from the image area rate of the second image pattern N to some extent.

Any of the cases described above exhibits substantially the same advantages as the advantages of the embodiment and the variations described above.

In the present embodiment, the first image pattern M is formed at a low image area rate on the front side of a single sheet P; whereas the second image pattern N is formed at a high image area rate on the back side of the sheet P. The detection marks R1, R2, R1', and R2' are formed on each side of the sheet P and detected. Thus, the adjustment mode is performed. Alternatively, the first image pattern M and the second image pattern N may be formed on different sheets P. That is, the first image pattern M may be formed at a low image area rate on a sheet P (as a first sheet P); whereas the second image pattern N may be formed at a high image area rate on another sheet P (as a second sheet P). The detection marks R1, R2, R1', and R2' are formed on each of the first sheet P and the second sheet P and detected in the adjustment mode.

In the present embodiment, the detection marks R1, R2, R1', and R2' for the front side of the sheet P and the detection marks R1, R2, R1', and R2' for the back side of the sheet P are formed on the intermediate transfer belt 8 so that the lengths H1 and H1' in the sheet conveying direction between the detection marks R1 and R2 and between the detection marks R1' and R2', respectively, before being transferred and formed on the front side of the sheet P match the lengths H2 and H2' in the sheet conveying direction between the detection marks R1 and R2 and between the detection marks R1' and R2' before being transferred and formed on the back side of the sheet P (i.e., H1=H2, H1'=H2'). Alternatively, even in a case in which the lengths H1 and H1' in the sheet conveying direction between the detection marks R1 and R2 and between the detection marks R1' and R2', respectively, before being transferred and formed on the front side of the sheet P do not match the lengths H2 and H2' in the sheet conveying direction between the detection marks R1 and R2 and between the detection marks R1' and R2', respectively, before being transferred and formed on the back side of the sheet P, for example, in a case in which the detection marks R1, R2, R1', and R2' are formed at a given distance ratio (for example, H1=2×H2, H1'=2×H2'), the difference in distance (|H1−2×H2|) of the detection marks R1 and R2 on the sheet P may be obtained in consideration of the original distance ratio, and the adjustment mode may be performed based on the difference in image magnification in the sheet conveying direction of the images caused by the difference in image area rate.

Any of the cases described above exhibits substantially the same advantages as the advantages of the embodiment and the variations described above.

According to the embodiments of the present disclosure, an image forming apparatus and an adjustment method are provided that reduce changes of image magnification in the sheet conveying direction, regardless of the image area rate of toner images transferred onto surfaces of one or more sheets conveyed to a transfer nip.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. An image forming apparatus comprising:

an image bearer configured to bear a toner image;

a transfer rotator configured to contact the image bearer to form a transfer nip between the transfer rotator and the image bearer, the transfer rotator being configured to transfer the toner image from the image bearer onto a sheet conveyed to the transfer nip;

an adjuster configured to adjust at least one of a relative difference in linear velocity of the transfer rotator to the image bearer at the transfer nip and a relative contact pressure of the transfer rotator to the image bearer at the transfer nip;

circuitry configured to, based on a difference in image magnification, in a direction of conveyance of the sheet, of toner images transferred onto surfaces of one or more sheets conveyed to the transfer nip, cause the adjuster to reduce the difference in image magnification; and a detector, wherein the detector is configured to detect, as a first distance, a distance between detection marks on a first sheet in a direction of conveyance of the first sheet, the detection marks being transferred onto different positions from each other in the direction of conveyance of the first sheet, the first sheet bearing a first image pattern transferred, wherein the detector is configured to detect, as a second distance, a distance between the detection marks on a second sheet in a direction of conveyance of the second sheet, the detection marks being transferred onto different positions from each other in the direction of conveyance of the second sheet to be located identically to the detection marks on the first sheet, the second sheet bearing a second image pattern transferred, the second image pattern having an image area rate greater than an image area rate of the first image pattern, and wherein the circuitry is configured to cause the adjuster to adjust a difference in distance between the first distance and the second distance detected by the detector to be equal to or less than a given value.

2. The image forming apparatus according to claim 1, wherein the image area rate of the first image pattern is 0%, and wherein the image area rate of the second image pattern is 25% or greater.

3. The image forming apparatus according to claim 1, further comprising a sheet reversal device configured to convey the sheet bearing the toner image, which has been transferred onto a front side of the sheet, toward the transfer nip to transfer another toner image from the image bearer onto a back side of the sheet at the transfer nip, wherein the first sheet and the second sheet are the front side and the back side, respectively, of the sheet as a single sheet, wherein the first image pattern is formed on the front side of the single sheet, and wherein the second image pattern is formed on the back side of the single sheet.

4. The image forming apparatus according to claim 1, wherein the adjuster is configured to adjust at least one of a rotational speed of the transfer rotator and a contact pressure of the transfer rotator against the image bearer, and wherein the circuitry is configured to cause the adjuster to:

increase at least one of the rotational speed and the contact pressure in a case in which the difference in distance exceeds the given value and in a case in which the first distance is greater than the second distance; and decrease at least one of the rotational speed and the contact pressure in a case in which the difference in distance exceeds the given value and in a case in which the first distance is equal to or less than the second distance.

5. The image forming apparatus according to claim 1, further comprising:

a display, wherein the circuitry is configured to display a warning on the display in a case in which the difference in distance is not equal to or less than the given value after the circuitry executes a given number of times of an adjustment mode to control the adjuster based on the difference in distance.

6. The image forming apparatus according to claim 1, wherein the circuitry is configured to cause the adjuster to:

adjust the contact pressure in a case in which the difference in image magnification is greater than a given amount; and adjust the difference in linear velocity in a case in which the difference in image magnification is equal to or less than the given amount.

7. The image forming apparatus according to claim 1, further comprising an exposure device configured to emit light and write a latent image, wherein the circuitry is configured to adjust a writing timing and an exposure distribution of the exposure device for each of a main scanning direction and a sub-scanning direction after the circuitry executes an adjustment mode to control the adjuster.

8. The image forming apparatus according to claim 1, wherein at least one of the image bearer and the transfer rotator is an elastic belt.

9. An adjustment method for an image forming apparatus, the image forming apparatus including an image bearer, a transfer rotator configured to contact the image bearer to form a transfer nip between the transfer rotator and the image bearer, and an adjuster, the method comprising:

transferring a first toner image and a second toner image having an image area rate different from an image area rate of the first toner image onto a front side and a back side, respectively, of a sheet conveyed to the transfer nip or onto a surface of a first sheet and a surface of a second sheet, respectively, the first sheet and the second sheet being conveyed to the transfer nip;

causing, based on a difference in image magnification, in a direction of conveyance of the sheet or in a direction of conveyance of the first sheet and the second sheet, of the first toner image and the second toner image on the front side and the back side, respectively, of the sheet or on the surface of the first sheet and the surface of the second sheet, respectively, the adjuster to reduce the difference in image magnification;

detecting, as a first distance, a distance between detection marks on the first sheet in a direction of conveyance of the first sheet, the detection marks being transferred onto different positions from each other in the direction of conveyance of the first sheet, the first sheet bearing a first image pattern transferred;

detecting, as a second distance, a distance between the detection marks on the second sheet in a direction of conveyance of the second sheet, the detection marks being transferred onto different positions from each other in the direction of conveyance of the second sheet to be located identically to the detection marks on the first sheet, the second sheet bearing a second image pattern transferred, the second image pattern having an image area rate greater than an image area rate of the first image pattern; and adjusting a difference in distance between the first distance and the second distance to be equal to or less than a given value.

10. The method according to claim 9, wherein:

the image area rate of the first image pattern is 0%, and the image area rate of the second image pattern is 25% or greater.

11. The method according to claim 9, wherein:

the first sheet and the second sheet are the front side and the back side, respectively, of the sheet as a single sheet, the first image pattern is formed on the front side of the single sheet, and the second image pattern is formed on the back side of the single sheet.

12. The method according to claim 9, further comprising:

adjusting, by the adjuster, at least one of a rotational speed of the transfer rotator and a contact pressure of the transfer rotator against the image bearer, increasing, by the adjuster, at least one of the rotational speed and the contact pressure in a case in which the difference in distance exceeds the given value and in a case in which the first distance is greater than the second distance; and decreasing, by the adjuster, at least one of the rotational speed and the contact pressure in a case in which the difference in distance exceeds the given value and in a case in which the first distance is equal to or less than the second distance.

13. The method according to claim 9, further comprising:

display a warning in a case in which the difference in distance is not equal to or less than the given value after the circuitry executes a given number of times of an adjustment mode to control the adjuster based on the difference in distance.

14. The method according to claim 9, further comprising:

adjusting a contact pressure of the transfer rotator to the image bearer at the transfer nip in a case in which the difference in image magnification is greater than a given amount; and adjusting a difference in linear velocity of the transfer rotator to the image bearer at the transfer nip in a case in which the difference in image magnification is equal to or less than the given amount.

15. The method according to claim 9, further comprising:

adjusting a writing timing and an exposure distribution of an exposure device for each of a main scanning direction and a sub-scanning direction after the circuitry executes an adjustment mode to control the adjuster.

16. The method according to claim 9, wherein:

at least one of the image bearer and the transfer rotator is an elastic belt.

* * * * *